US011502413B2

(12) United States Patent
Park et al.

(10) Patent No.: US 11,502,413 B2
(45) Date of Patent: Nov. 15, 2022

(54) ELECTRONIC DEVICE INCLUDING ANTENNA THAT RADIATES WAVES BY A NON-CONDUCTING PORTION

(71) Applicant: Samsung Electronics Co., Ltd., Gyeonggi-do (KR)

(72) Inventors: Seongjin Park, Gyeonggi-do (KR); Minhong Do, Gyeonggi-do (KR); Kyungrok Lee, Gyeonggi-do (KR); Seokwoo Lee, Gyeonggi-do (KR); Sukchan Hong, Gyeonggi-do (KR); Jaebong Chun, Gyeonggi-do (KR); Hyunsuk Choi, Gyeonggi-do (KR)

(73) Assignee: Samsung Electronics Co., Ltd

( * ) Notice: Subject to any disclaimer, the term of this patent is extended or adjusted under 35 U.S.C. 154(b) by 62 days.

(21) Appl. No.: 17/104,441

(22) Filed: Nov. 25, 2020

(65) Prior Publication Data

US 2021/0159599 A1 May 27, 2021

(30) Foreign Application Priority Data

Nov. 25, 2019 (KR) ..... 10-2019-0152269

(51) Int. Cl.
*H01Q 1/24* (2006.01)
*H01Q 9/04* (2006.01)
(Continued)

(52) U.S. Cl.
CPC ..... *H01Q 9/0407* (2013.01); *H01Q 1/421* (2013.01); *H01Q 1/48* (2013.01); *H01Q 21/10* (2013.01); *H01Q 1/24* (2013.01)

(58) Field of Classification Search
CPC ..... H01Q 9/0407; H01Q 1/421; H01Q 1/243; H01Q 1/48; H01Q 21/065; H01Q 21/10
See application file for complete search history.

(56) References Cited

U.S. PATENT DOCUMENTS

2013/0050056 A1 2/2013 Lee et al.
2018/0241115 A1 8/2018 Cho et al.
(Continued)

FOREIGN PATENT DOCUMENTS

CN 110248008 A * 9/2019 ..... H01Q 1/22
CN 110444855 A * 11/2019 ..... H01Q 1/22
(Continued)

OTHER PUBLICATIONS

International Search Report dated Mar. 25, 2021 issued in counterpart application No. PCT/KR2020/016845, 7 pages.

*Primary Examiner* — Hoang V Nguyen
(74) *Attorney, Agent, or Firm* — The Farrell Law Firm, P.C.

(57) ABSTRACT

Disclosed is an electronic device including a housing having a front surface, a rear surface, and a side surface partially surrounding a space between the front surface and the rear surface, wherein at least one of the front surface, the rear surface, and the side surface comprises a non-conductive portion, and at least a partial region of the non-conductive portion comprises a first through hole, a component at least partially overlapping the first through hole when the non-conductive portion is viewed from outside the housing, wherein the component is disposed at a position spaced apart from the non-conductive portion by a first distance, and an antenna structure disposed at a position spaced apart from the non-conductive portion by a second distance shorter than the first distance, wherein the antenna structure is configured to radiate radio waves through the non-conductive portion, and comprises at least one second through hole.

20 Claims, 28 Drawing Sheets

(51) Int. Cl.

| | |
|---|---|
| ***H01Q 1/48*** | (2006.01) |
| ***H01Q 21/10*** | (2006.01) |
| ***H01Q 1/42*** | (2006.01) |

(56) References Cited

U.S. PATENT DOCUMENTS

| | | | | |
|---|---|---|---|---|
| 2018/0269561 | A1 | 9/2018 | Kim et al. | |
| 2018/0358686 | A1* | 12/2018 | Park | H01Q 21/08 |

FOREIGN PATENT DOCUMENTS

| | | |
|---|---|---|
| KR | 1020170084632 | 7/2017 |
| KR | 1020190106555 | 9/2019 |

* cited by examiner

ELECTRONIC DEVICE INCLUDING ANTENNA THAT RADIATES WAVES BY A NON-CONDUCTING PORTION

CROSS-REFERENCE TO RELATED APPLICATION(S)

This application is based on and claims priority under 35 U.S.C. § 119 to Korean Patent Application No. 10-2019-0152269, filed on Nov. 25, 2019, in the Korean Intellectual Property Office, the disclosure of which is incorporated herein by reference in its entirety.

BACKGROUND

1. Field

The disclosure relates generally to an electronic device, and more particularly, to an electronic device including an antenna that radiates waves using a non-conducting portion.

2. Description Of Related Art

Wireless communication systems now support higher data rates to meet the ever-increasing demand for wireless data traffic. Regarding existing wireless communication systems, technical development has been pursued to increase spectral efficiency in order to increase data rates. However, as the demand for data traffic is further accelerated due to the increased demand for smartphones and tablet personal computers (PCs) and the rapid increase in applications that require a large amount of traffic based thereon, a wireless communication system using a high-frequency band is applied to recent wireless communication systems.

In an electronic device including a conductive member in a housing, an antenna for wireless communication using a high-frequency band (e.g., a millimeter-wave band such as, a fifth generation (5G) antenna) may have difficulty in radiating radio waves through the conductive member. In addition, since a non-conductive portion formed for radio-wave radiation may be limited in size, it may be difficult to arrange a legacy antenna and an antenna using a high-frequency band together in the non-conductive portion.

As such, there is a need in the art for an electronic device including an antenna that overcomes these radiating deficiencies in the prior art.

SUMMARY

This disclosure is provided to address at least the above-mentioned problems and/or disadvantages and to provide at least the advantages described below.

Accordingly, an aspect of the disclosure is to provide an electronic device including an antenna that radiates radio waves using a non-conductive portion and a component using a hole formed in the non-conductive portion.

In accordance with an aspect of the disclosure, an electronic device includes a housing having a front surface, a rear surface, and a side surface partially surrounding a space between the front surface and the rear surface, wherein at least one of the front surface, the rear surface, and the side surface comprises a non-conductive portion, and at least a partial region of the non-conductive portion comprises a first through hole, a component at least partially overlapping the first through hole when the non-conductive portion is viewed from outside the housing, wherein the component is disposed at a position spaced apart from the non-conductive portion by a first distance, and an antenna structure disposed at a position spaced apart from the non-conductive portion by a second distance shorter than the first distance, wherein the antenna structure is configured to radiate radio waves through the non-conductive portion, wherein the antenna structure comprises at least one second through hole.

BRIEF DESCRIPTION OF THE DRAWINGS

The above and other aspects, features, and advantages of certain embodiments of the disclosure will be more apparent from the following description taken in conjunction with the accompanying drawings, in which.

In connection with the description of the drawings, the same or similar components may be denoted by the same or similar reference numerals.

DETAILED DESCRIPTION

Figure 1:
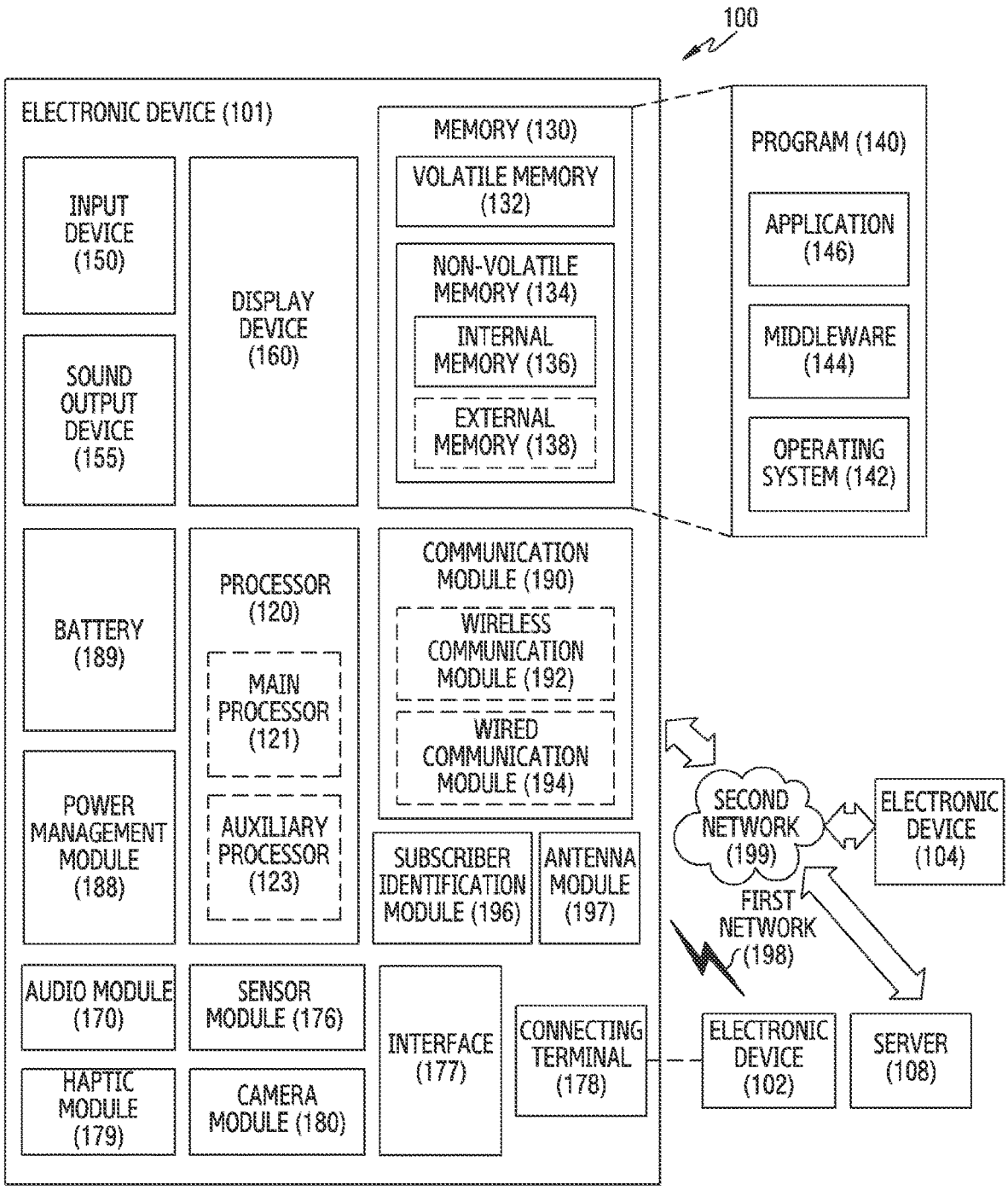
FIG. 1 is a block diagram of an electronic device according to an embodiment.

Embodiments will be described with reference to the accompanying drawings. For convenience of description, the components illustrated in the drawings may be exaggerated or reduced in size, and the disclosure is not necessarily limited to the illustrated examples. Detailed descriptions of known functions and/or configurations will be omitted for the sake of clarity and conciseness.

The electronic device according to embodiments may be one of various types of electronic devices including, without limitation, a portable communication device (e.g., a smartphone), a computer device, a portable multimedia device, a portable medical device, a camera, a wearable device, or a home appliance.

Embodiments of the disclosure and the terms used therein are not intended to limit the technological features set forth herein to particular embodiments and include various changes, equivalents, or replacements for a corresponding embodiment. In the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases.

As used herein, such terms as "1st" and "2nd," or "first" and "second" may be used to simply distinguish a corresponding component from another, and do not limit the components in importance or order. It is to be understood that if an element (e.g., a first element) is referred to, with or without the term "operatively" or "communicatively", as "coupled with," "coupled to," "connected with," or "connected to" another element (e.g., a second element), this indicates that the first element may be coupled with the second element directly (e.g., wiredly), wirelessly, or via a third element.

In the following disclosure, the radio-wave radiation performance of an antenna can be secured through a non-conductive portion in which a hole is formed, and a component using the hole and the non-conductive portion can be shared so as to improve the aesthetics of the electronic device.

FIG. 1 is a block diagram illustrating an example electronic device 101 in a network environment 100 according to an embodiment.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., long-range wireless communication network). The electronic device 101 may communicate with the electronic device 104 via the server 108. The electronic device 101 may include a processor 120, memory 130, an input module 150, a sound output module 155, a display module 160, an audio module 170, a sensor module 176, an interface 177, a connecting terminal 178, a haptic module 179, a camera module 180, a power management module 188, a battery 189, a communication module 190, a subscriber identification module (SIM) card 196, and an antenna module 197. At least one of the components may be omitted from the electronic device 101, or one or more other components may be added in the electronic device 101. Some of the components may be implemented as single integrated circuitry.

The processor 120 may execute a program 140 to control at least one other component (e.g., a hardware or software component) of the electronic device 101 coupled with the processor 120, and may perform various data processing or computation. As at least part of the data processing or computation, the processor 120 may store a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), or an auxiliary processor 123 (e.g., a graphics processing unit (GPU), a neural processing unit (NPU), an image signal processor (ISP), a sensor hub processor, or a communication processor (CP)) that is operable independently from, or in conjunction with, the main processor 121. For example, if the electronic device 101 includes the main processor 121 and the auxiliary processor 123, the auxiliary processor 123 may be adapted to consume less power than the main processor 121, or to be specific to a function. The auxiliary processor 123 may be implemented as separate from, or as part of the main processor 121.

The auxiliary processor 123 may control at least some of functions or states related to at least one component (e.g., the display module 160, the sensor module 176, or the communication module 190) among the components of the electronic device 101, instead of the main processor 121 while the main processor 121 is in an inactive sleep) state, or together with the main processor 121 while the main processor 121 is in an active state (e.g., executing an application). The auxiliary processor 123 (e.g., an ISP or a CP) may be implemented as part of the camera module 180 or the communication module 190 functionally related to the auxiliary processor 123. The auxiliary processor 123 (e.g., a neural network processing device) may include a hardware structure specialized for processing an artificial intelligence model created through machine learning. Such learning may be performed in the electronic device 101 on which artificial intelligence is performed or may be performed through the server 108.

A learning algorithm may include supervised learning, unsupervised learning, semi-supervised learning, or reinforcement learning, but is not limited to the aforementioned example. The artificial intelligence model may include a plurality of artificial neural network layers. The artificial neural network may be one of a deep neural network (DNN), a convolutional neural networks (CNN), a recurrent neural network (RNN), a restricted Boltzmann machine (RBM), a deep belief network (DBN), a bidirectional recurrent deep neural network (BRDNN), a deep Q-network, or a combination of at least two of those elements, but is not limited to the aforementioned example. In addition to the hardware structure, additionally or alternatively, the artificial intelligence model may include a software structure.

The memory 130 may store various data used by at least the processor 120 or the sensor module 176 of the electronic device 101. The various data may include the program 140 and input data or output data for a command related thereto. The memory 130 may include the volatile memory 132 or the non-volatile memory 134.

The program 140 may be stored in the memory 130 as software and may include an operating system (OS) 142, middleware 144, or an application 146.

The input module 150 may receive a command or data to be used by the processor 120 of the electronic device 101, from the outside (e.g., a user) of the electronic device 101. The input module 150 may include a microphone, a mouse, a keyboard, a key (e.g., button), or a digital pen (e.g., a stylus pen).

The sound output module 155 may output sound signals to the outside of the electronic device 101. The sound output module 155 may include a speaker or a receiver. The speaker may be used for general purposes, such as playing multimedia or playing record. The receiver may be used for an incoming call. The receiver may be implemented as separate from, or as part of the speaker.

The display module 160 may visually provide information to the user of the electronic device 101. The display module 160 may include a display, a hologram device, or a projector and control circuitry to control a corresponding one of the display, hologram device, and projector. The display module 160 may include touch sensor adapted to detect a touch, or a pressure sensor adapted to measure the intensity of force incurred by the touch.

The audio module 170 may convert a sound into an electrical signal and vice versa. The audio module 170 may obtain the sound via the input module 150, or output the sound via the sound output module 155, or an external electronic device 102 (e.g., a speaker or a headphone) directly or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device 102 directly (e.g., wiredly) or wirelessly. The interface 177 may include a high definition multimedia interface (HDMI), a universal serial bus (USB) interface, a secure digital (SD) card interface, or an audio interface.

A connecting terminal 178 may include a connector via which the electronic device 101 may be physically connected with the external electronic device 102. The connecting terminal 178 may include a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include a motor, a piezoelectric element, or an electric stimulator.

The camera module 180 may capture a still image or moving images. The camera module 180 may include one or more lenses, image sensors, ISPs, or flashes.

The power management module 188 may manage power supplied to the electronic device 101. The power management module 188 may be implemented as at least part of a power management integrated circuit (PMIC).

The battery 189 may supply power to at least one component of the electronic device 101. The battery 189 may include a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the AP 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device 104 via the first network 198 (e.g., short-range communication network, such as Bluetooth™, wireless-fidelity (Wi-Fi) direct, or infrared data association (IrDA)) or the second network 199 (e.g., a long-range communication network, such as a legacy cellular network, 5G network, a next-generation communication network, the Internet, or a computer network (e.g., LAN or wide area network (WAN)). These various types of communication modules may be implemented as a single component (e.g., a single chip), or may be implemented as multi components (e.g., multi chips) separate from each other.

The wireless communication module 192 may identify or authenticate the electronic device 101 in a communication network, such as the first network 198 or the second network 199, using subscriber information international mobile subscriber identity (IMSI)) stored in the subscriber identification module 196.

The wireless communication module 192 may support a 5G network evolved from a fourth generation (4G) network and a new radio (NR) access technology. The NR access technology may support enhanced mobile broadband (eMBB), massive machine type communications (mMTC), or ultra-reliable and low-latency communications (URLLC). The wireless communication module 192 may support a high frequency band (e.g., an mmWave band) to achieve a high data rate. The wireless communication module 192 may support various technologies for securing performance in a high frequency band, such as beamforming, massive array multiple-input and multiple-output (NEMO), and full-dimensional MIMO (FD-MIMO), an array antenna, analog beam-forming, or a large scale antenna. The wireless communication module 192 may support various requirements defined in the electronic device 101, an external electronic device 104, or the second network 199. The wireless communication module 192 may support a peak data rate 20 Gbps or more) for realizing eMBB, a loss coverage (e.g., 164 dB or to less) for realizing mMTC, or U-plane latency (e.g., 0.5 ms or less or a round trip of 1 ms or less for each of downlink (DL) and uplink (UL)) for realizing URLCC.

The antenna module 197 may transmit or receive a signal or power to or from the external electronic device of the electronic device 101. The antenna module 197 may include an antenna including a radiating element including a conductive material or a conductive pattern formed in or on a substrate, such as a printed circuit board (PCB). The antenna module 197 may include a plurality of antennas (e.g., array antenna). In such a case, at least one antenna appropriate for a communication scheme used in the communication network, such as the first network 198 or the second network 199, may be selected by the communication module 190 from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

The antenna module 197 may construct an mmWave antenna module. The mmWave antenna module may include a PCB, an RFIC disposed on or adjacent to a first face (e.g., a bottom face) of the PCB and capable of supporting a designated high frequency band (e.g., an mmWave band), and a plurality of antennas (e.g., an array antenna) disposed on or adjacent to a second face (e.g., a top face or a side face) of the PCB and capable of transmitting or receiving a signal in the designated high frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 or 104 may be a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To this end, technologies of cloud computing, distributed computing, mobile edge computing (MEC), or client-server computing may be used.

The electronic device 101 may provide an ultra-low latency service using distributed computing or mobile edge computing. In another embodiment, the external electronic device 104 may include an Internet of things (IoT) device. The server 108 may be an intelligent server using machine learning and/or neural networks. The external electronic device 101 or the server 108 may be included in the second network 199. The electronic device 101 may be applied to an intelligent service (e.g., a smart home, a smart city, a smart car, or health care) based on a 5G communication technique and an IoT related technique.

Figure 2:
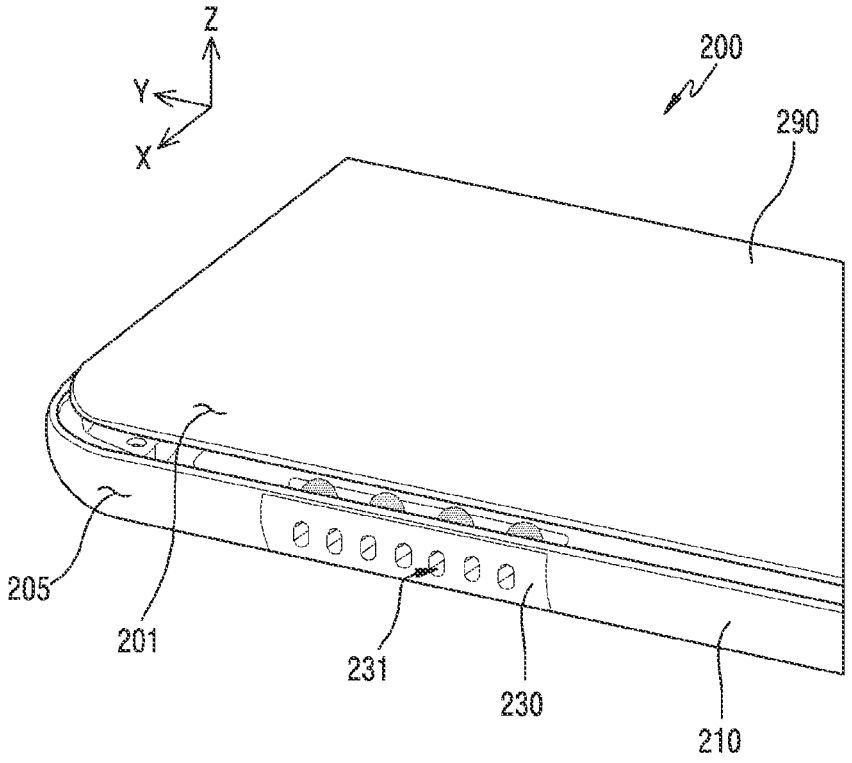
FIG. 2 illustrates a portion of an electronic device according to an embodiment.
Figure 3:
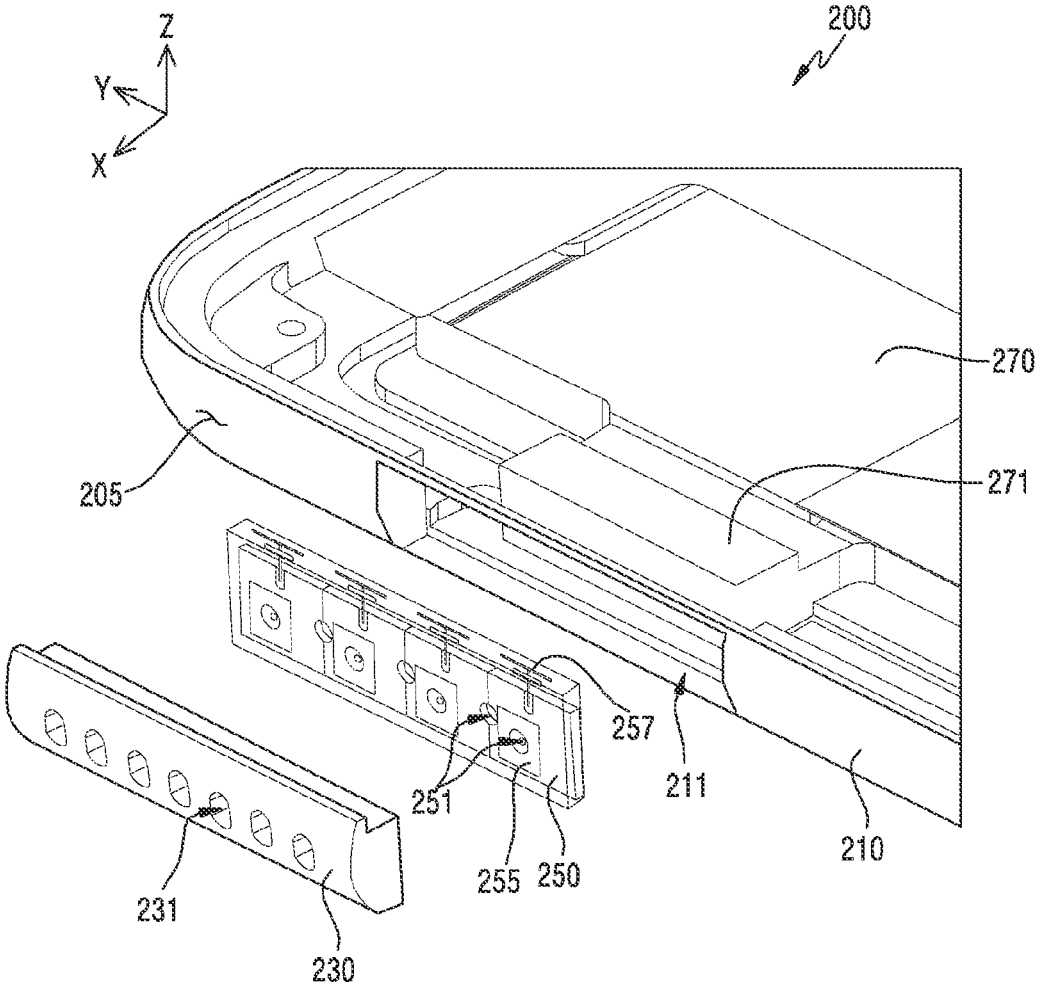
FIG. 3 is an exploded perspective view illustrating a portion of an electronic device according to an embodiment.
Figure 4:
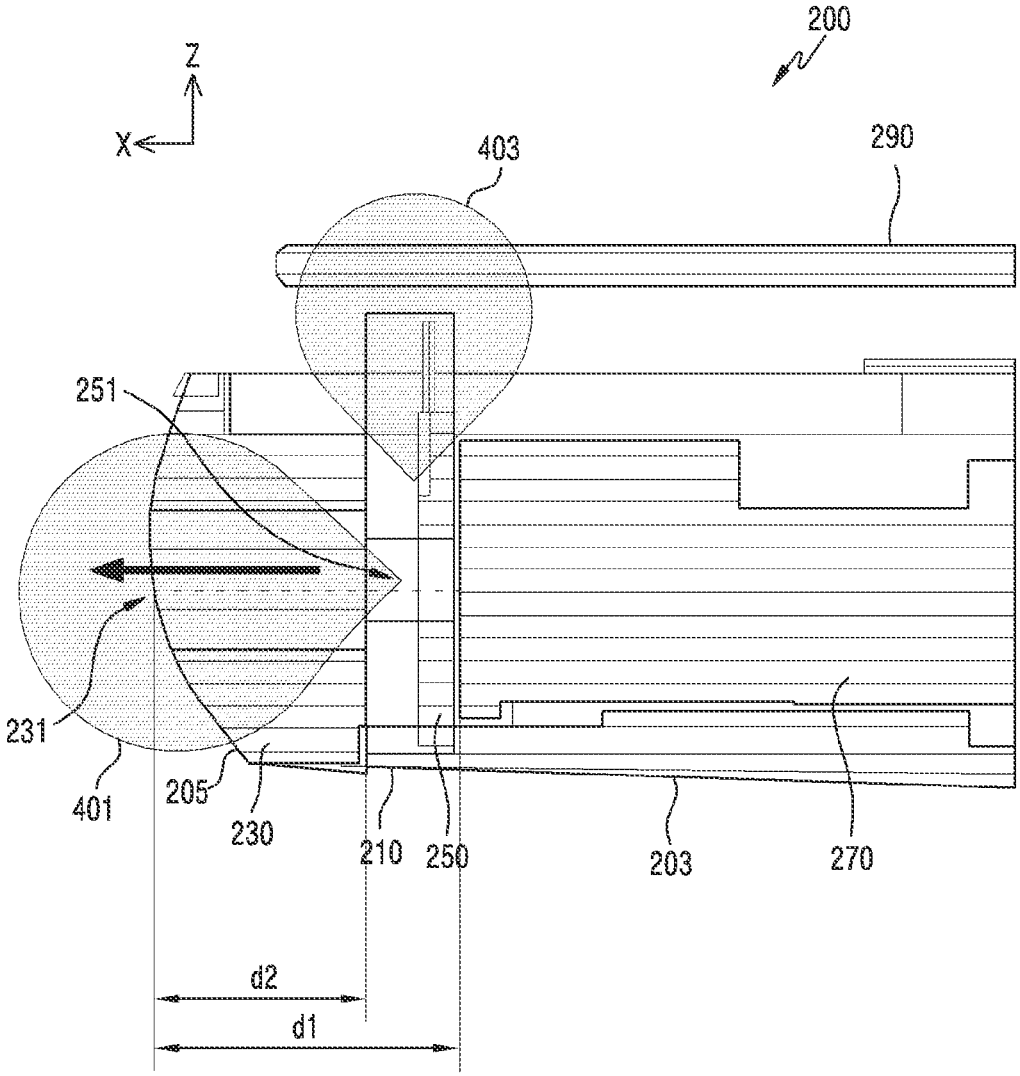
FIG. 4 is a cross-sectional view illustrating a portion of an electronic device according to an embodiment.
Figure 5:
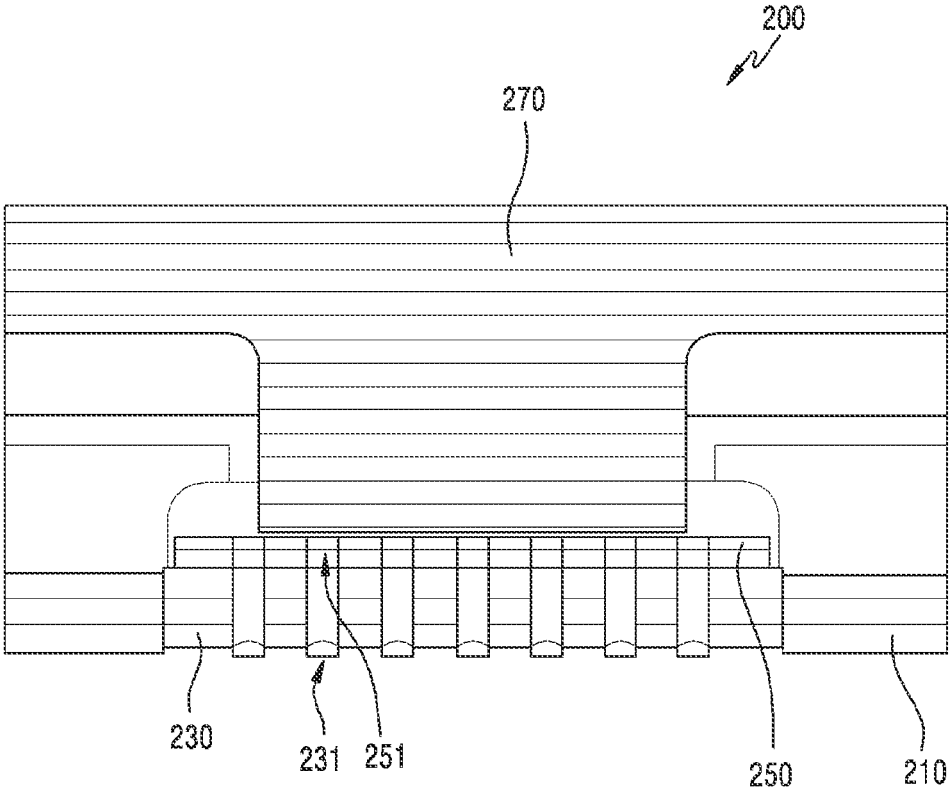
FIG. 5 is a plan view illustrating a portion of an electronic device according to an embodiment.

FIG. 2 illustrates a portion of an electronic device according to an embodiment, FIG. 3 is an exploded perspective view illustrating a portion of an electronic device according to an embodiment, FIG. 4 is a cross-sectional view illustrating a portion of an electronic device, and FIG. 5 is a plan view illustrating a portion of an electronic device according to an embodiment.

Referring to FIGS. 2 to 5, an electronic device 200 may include a housing 210, an antenna structure 250, a sound module 270, and/or a display 290. However, the configuration of the electronic device 200 is not limited thereto. At least one of the above-mentioned components may be omitted, or the electronic device 200 may further include one or more other components. The sound module 270 may be replaced with another component of the electronic device 200, such as a camera, a fingerprint sensor, a proximity sensor, or an iris sensor.

The housing 210 may form the exterior of the electronic device 200. The housing 210 may include a front surface 201 (or a top surface), a rear surface 203 (or a bottom surface), and a side surface 205 partially surrounding the space between the front surface 201 and the rear surface 203. For example, the side surface 205 may be visible when the thin surface of the electronic device 200 is viewed. The front surface 201 may be a region other than the side surface 205, and through which a screen output through the display 290 is exposed to the outside. The rear surface 203 may be facing away from the front surface 201. The screen of the display 290 may be partially exposed to the outside through the rear surface 203 and/or the side surface 205.

The housing 210 may fix or support the inner components of the electronic device 200. For example, the housing 210 may provide a space in which the inner components of the electronic device 200 are capable of being seated and may fix and support the inner components seated therein.

At least one through hole 231 may be formed in the side surface 205 of the housing 210 and may be used as a sound input/output passage by the sound module 270 seated inside the housing 210. For example, sound output from the input/output unit 271 of the sound module 270 may be output to the outside through the at least one through hole 231, and external sound may be input to the input/output unit 271 of the sound module 270 through the at least one through hole 231.

FIGS. 2 and 3 illustrate when multiple through holes 231 are formed in the side of the housing 210, but the disclosure is not limited thereto. That is, one through hole 231 may be formed therein. The at least one through hole 231 may be used by a component seated in the housing 210. For example, when the component requires input/output of sound or light excluding electromagnetic waves, the at least one through hole 231 may be used as an input/output passage for sound or light related to the component. The component may include the sound module 270, a camera, or a sensor module. The sensor module may include a fingerprint sensor, a proximity sensor, or an iris sensor.

The housing 210 may include a conductive portion and a non-conductive portion. For example, at least a portion of the housing 210 may be formed of a metal material. Embodiments will describe the side surface 205 of the housing 210 including a conductive portion and a non-conductive portion.

The side surface 205 of the housing 210 may include a conductive material and may have an opening 211 formed in a partial region thereof. In this case, a cover 230 may be inserted into and disposed in the opening 211. For example, the cover 230 may be included in the side surface 205. The third outer layer 231 may be formed in the cover 230. In another embodiment, the side surface 205 of the housing 210 may include a conductive portion and a non-conductive portion. The at least one through hole 231 may be integrally formed in the non-conductive portion.

The cover 230 may include a non-conductive material (e.g., a polycarbonate material). The material of the cover 230 may be different from that of a substrate included in the antenna structure 250. At least a portion of the cover 230 may be painted or coated.

The antenna structure 250 may transmit/receive a signal to/from the outside (e.g., an external electronic device). The antenna structure 250 may include at least one antenna including a radiator (an antenna element) made of a conductor or a conductive pattern formed on the PCB. The antenna structure 250 may include a plurality of patch antennas 255 disposed on the substrate to be spaced apart from each other by a predetermined distance. The patch antennas 255 may include a conductive patch. The plurality of patch antennas 255 may form an antenna array. The antenna structure 250 may further include a plurality of dipole antennas 257 that may form an antenna array. For example, a plurality of antenna elements may be disposed on the substrate to be spaced apart from each other by a predetermined distance. The plurality of antenna elements may include a first antenna element including a first conductive patch and a second antenna element including a second conductive patch.

The plurality of antenna elements may also include a third antenna element including a first conductive pattern and a second conductive pattern, and a fourth antenna element including a third conductive pattern and a fourth conductive pattern. The first conductive pattern and the second conductive pattern may form a first dipole antenna, and the third conductive pattern and the fourth conductive pattern may form a second dipole antenna. In addition to at least one antenna, other components (e.g., an RFIC) may be additionally included in the antenna structure 250. The antenna included in the antenna structure 250 may be an mmWave antenna for mmWave wireless communication using a millimeter-wave band. The plurality of dipole antennas 257 and the plurality of patch antennas 255 may operate in substantially the same frequency band or in different frequency bands.

Referring to FIG. 4, the plurality of patch antennas 255 included in the antenna structure 250 may form a beam pattern 401 in the lateral direction of the electronic device 200 (the X-axis direction or the Y-axis direction). For example, the plurality of patch antennas 255 may radiate radio waves through the cover 230 disposed on the side surface 205 of the housing 210. At least one through-hole 231 formed in the side surface 205 of the housing 210 may be used as a sound (or light) input/output passage by the sound module 270 (or a camera or sensor module). When the antenna structure 250 includes the plurality of dipole antennas 257, the plurality of dipole antennas 257 may form a beam pattern 403 in the forward direction of the electronic device 200 (the Z-axis direction).

The sound module 270 may include a sound input device (e.g., a microphone) and/or a sound output device (e.g., a speaker or a receiver). The sound module 270 is mounted inside the housing 210 and may have an input/output unit 271 through which sound is input and/or output. The input/output unit 271 may input and/or output sound through the at least one through hole 231 formed in the side surface 205 of the housing 210.

The sound module 270 may be disposed at a position spaced apart from the side surface 205 of the housing 210, in which the at least one through hole 231 is formed, by a first distance d1 toward the inside of the electronic device 200. The antenna structure 250 may be disposed at a position spaced apart from the side surface 205 of the housing 210, in which the at least one through hole 231 is formed, by a second distance d2, which is shorter than the first distance, toward the inside of the electronic device 200 (e.g., in the -X-axis direction or the -Y-axis direction). For example, the antenna structure 250 may be disposed between the side surface 205 of the housing 210 and the sound module 270.

The antenna structure 250 may include at least one through hole T251 which may prevent sound output from the sound module 270 or sound to be input to the sound module 270 from being blocked by the antenna structure 250. FIGS. 3 and 5 illustrate when a plurality of through holes 251 are formed in the antenna structure 250.

As illustrated in FIG. 5, the at least one through hole 231 formed in the side surface 205 of the housing 210 and the at least one through hole 251 formed in the antenna structure 250 may be aligned in the lateral direction of the electronic device 200. For example, the at least one through hole 231 formed in the side surface 205 of the housing 210 and the at least one through hole 251 formed in the antenna structure 250 may at least partially overlap each other when viewed in the lateral direction of the electronic device 200 (e.g., the X-axis direction or the Y-axis direction). Accordingly, the sound output from the input/output unit 271 of the sound module 270 can be output to the outside through the at least one through hole 251 formed in the antenna structure 250 and the at least one through hole 231 formed in the side surface 205 of the housing 210, and external sound can be input to the input/output unit 271 of the sound module 270 through the at least one through hole 251 formed in the antenna structure 250 and the at least one through hole 231 formed in the side surface 205 of the housing 210.

The display 290 may display various contents (e.g., a text, an image, a video, an icon, or a symbol) to the user. The display 290 may include a touch screen, and may receive touch, gesture, proximity, or hovering input that is made using an electronic pen or a part of the user's body.

Figure 6:
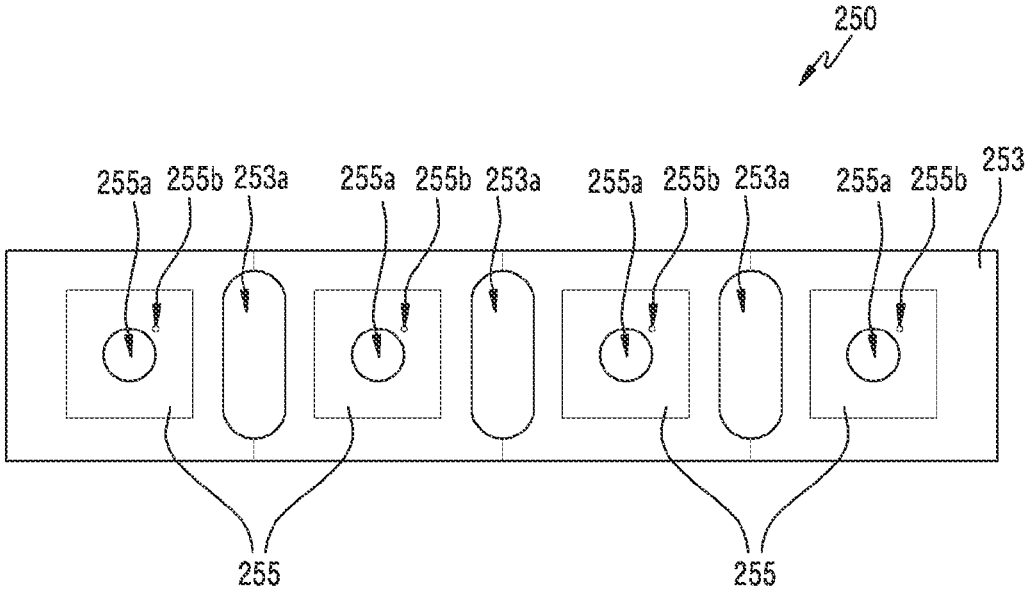
FIG. 6 illustrates an antenna structure according to an embodiment.

FIG. 6 illustrates an antenna structure according to an embodiment.

Referring to FIG. 6, an antenna structure 250 may include a substrate 253 and a plurality of patch antennas 255 disposed on the substrate 253 to be spaced apart from each other by a predetermined distance. The substrate 253 may include a ground region. The plurality of patch antennas 255 may be fed with power through feed points **255*b*, respectively. For example, the feed points 255*b*** may be probe feed positions.

At least one through hole 251 may be formed in the substrate 253. For example, the at least one through hole may include at least one first through hole **255*a* formed through at least one of the plurality of patch antennas 255 and/or at least one second through hole 253*a* formed in the region between the plurality of patch antennas 255** (e.g., a ground region).

The first through hole **255*a* may be formed through a corresponding patch antenna 255 and the substrate 253. The size (e.g., the width or diameter) and position of the at least one first through hole 255*a* may be set in consideration of antenna radiation efficiency. For example, the at least one first through hole 255***a* may be formed to pass through the center of the corresponding patch antenna 255 having an impedance of zero or close to zero. As another example, each first through hole 255*a* may be formed to have a diameter less than or equal to a predetermined size (e.g., 1 mm) such that the effect on antenna radiation is minimal. FIG. 6 illustrates when a plurality of first through holes 255*a* are formed to pass through the centers of respective patch antennas 255.

The at least one second through hole 253*a* may be, formed through the substrate 253 where the patch antennas 255 disposed on the substrate 253 are not disposed, such as between the patch antennas 255.

FIG. 6 illustrates when one second through hole 253*a* is formed between every two adjacent ones of the plurality of patch antennas 255. The size (e.g., the width or diameter) of the second through holes 253*a* may be set in consideration of the sound radiation efficiency of the sound module 270 together with the size of the first through holes 255*a*. For example, the sum of the total size of the first through holes 255*a* formed in the substrate 253 and the total size of the second through holes 253*a* may be set to satisfy the minimum resonance area for sound radiation, such as greater than or equal to a predetermined size (e.g., about 10 $mm^2$ to 15 $mm^2$ inclusive).

As illustrated in FIG. 6, in a structure in which four patch antennas 255 are disposed on the substrate 253 to be spaced apart from each other by a predetermined distance, a total of four through holes 255*a*, each of which penetrates the center of one of the four patch antennas 255, may be formed, and a total of three second through holes 253*a*, each of which is formed between every two adjacent ones of the four patch antennas 255, may be formed in a racetrack-type shape. For example, when the horizontal and vertical lengths of the substrate 253 are 19.2 mm and 4 mm, respectively, the diameter of the first through holes 255*a* may be set to about 1 mm. As another example, the width of the straight portions of the second through holes 253*a* may be set to about 1.2 mm, the height of the second through holes 253*a* may be set to about 2 mm, and the radius of the curved portions of the second through holes 253*a* may be set to about 0.6 mm. Accordingly, because the total size (area) of the first through holes 255*a* formed in the substrate 253 is $4*0.5^2*\pi$ and the total size (area) of the second through holes 253*a* formed in the substrate 253 is $3*(1.2*2+0.6^2*\pi)$, the sum thereof (e.g., about 13.7 $mm^2$) may have the predetermined size (e.g., 13 $mm^2$) or more that satisfies the minimum resonance area for sound radiation.

The first through holes 255*a* and the second through holes 253*a* may have various shapes. For example, the first through holes 255*a* may have a circular shape, and the second through holes 253*a* may have a racetrack-type shape. As another example, the first through holes 255*a* may have a square shape, and the second through holes 253*a* may have a rectangular shape.

Figure 7:
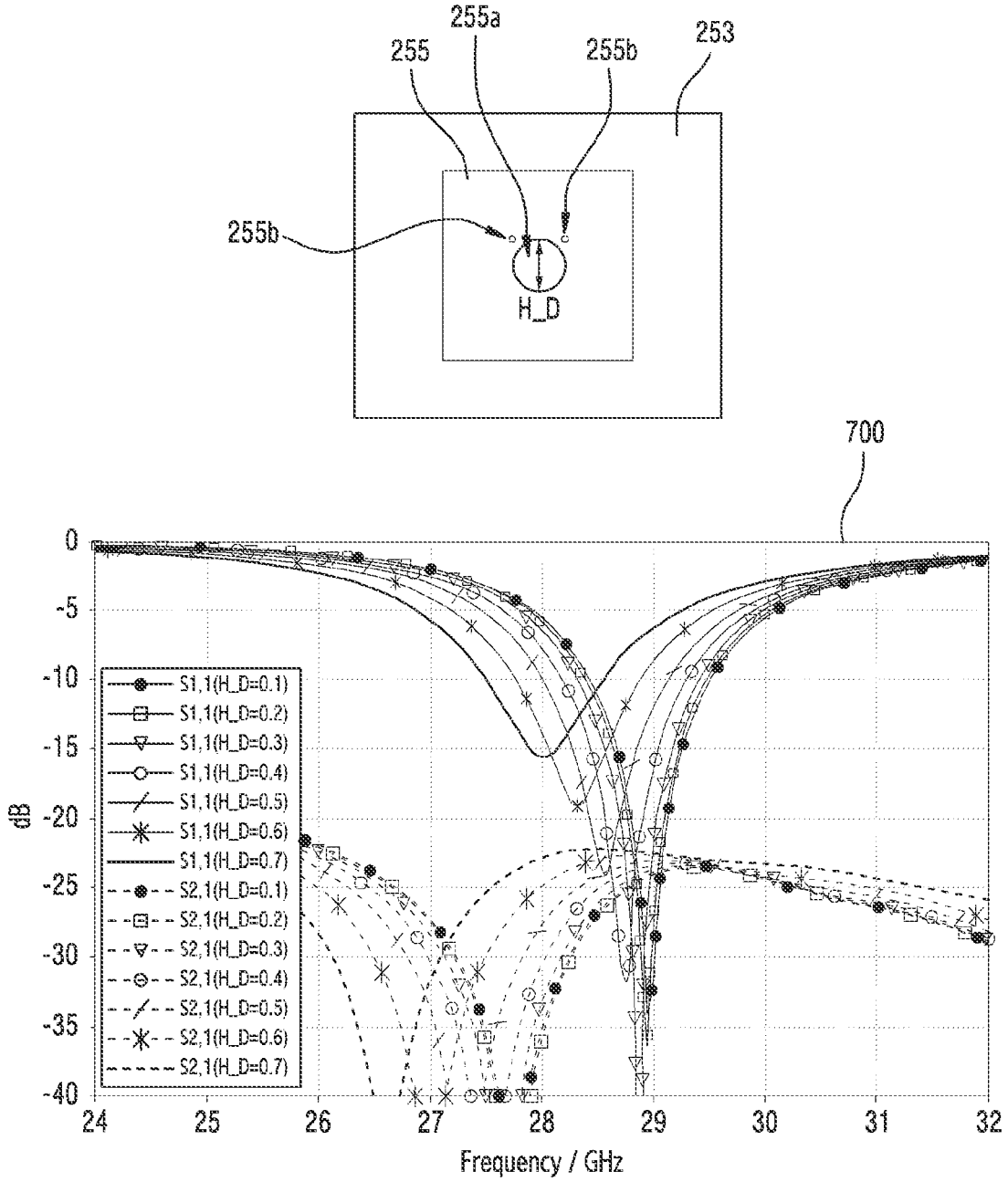
FIG. 7 illustrates a through hole formed in an antenna according to an embodiment and the resonance frequency of the antenna according to the size of the through hole.

FIG. 7 illustrates a through hole formed in an antenna according to an embodiment and the resonance frequency of the antenna according to the size of the through hole. Graph 700 of FIG. 7 illustrates the frequency characteristics of a patch antenna 255 according to the size (diameter H_D) of a first through hole 255*a* formed through the center of the patch antenna 255 disposed on the substrate 253.

Referring to FIG. 7, the resonant frequency of the patch antenna 255 may be shifted according to the size of the first through hole 255*a* formed in the patch antenna 255. However, the shifted resonance frequency can be compensated for by the size of the patch antenna 255. For example, the position of the first through hole 255*a* formed in the patch antenna 255 may be formed to pass through the center of the patch antenna 255 having an impedance of zero or close to zero. As another example, the size of the first through hole 255*a* may be formed to be less than or equal to a predetermined size (e.g., about 1 mm) in consideration of the size of the patch antenna 255 such that antenna radiation efficiency is not deteriorated. Referring to graph 700 of FIG. 7, when the diameter of the first through hole 255*a* is about 0.7 mm, it can be seen that the patch antenna 255 forms a resonance frequency at about 28 GHz. However, the resonance frequency determined according to the size of the first through hole 255*a* may be changed according to the size of the patch antenna 255. For example, when the size of the patch antenna 255 decreases, the resonance frequency may increase, and when the size of the patch antenna 255 increases, the resonance frequency may decrease.

When the first through hole 255*a* is formed in the center of the patch antenna 255 in a predetermined size (e.g., about 1 mm) or less, the reflection coefficient characteristic and gain of the patch antenna 255 may be similar to the characteristics of the first through hole 255*a*, in which the first through hole 255*a* is not formed in the patch antenna 255. For example, there is little performance degradation of the patch antenna 255 due to the first through hole 255*a*.

Figure 8:
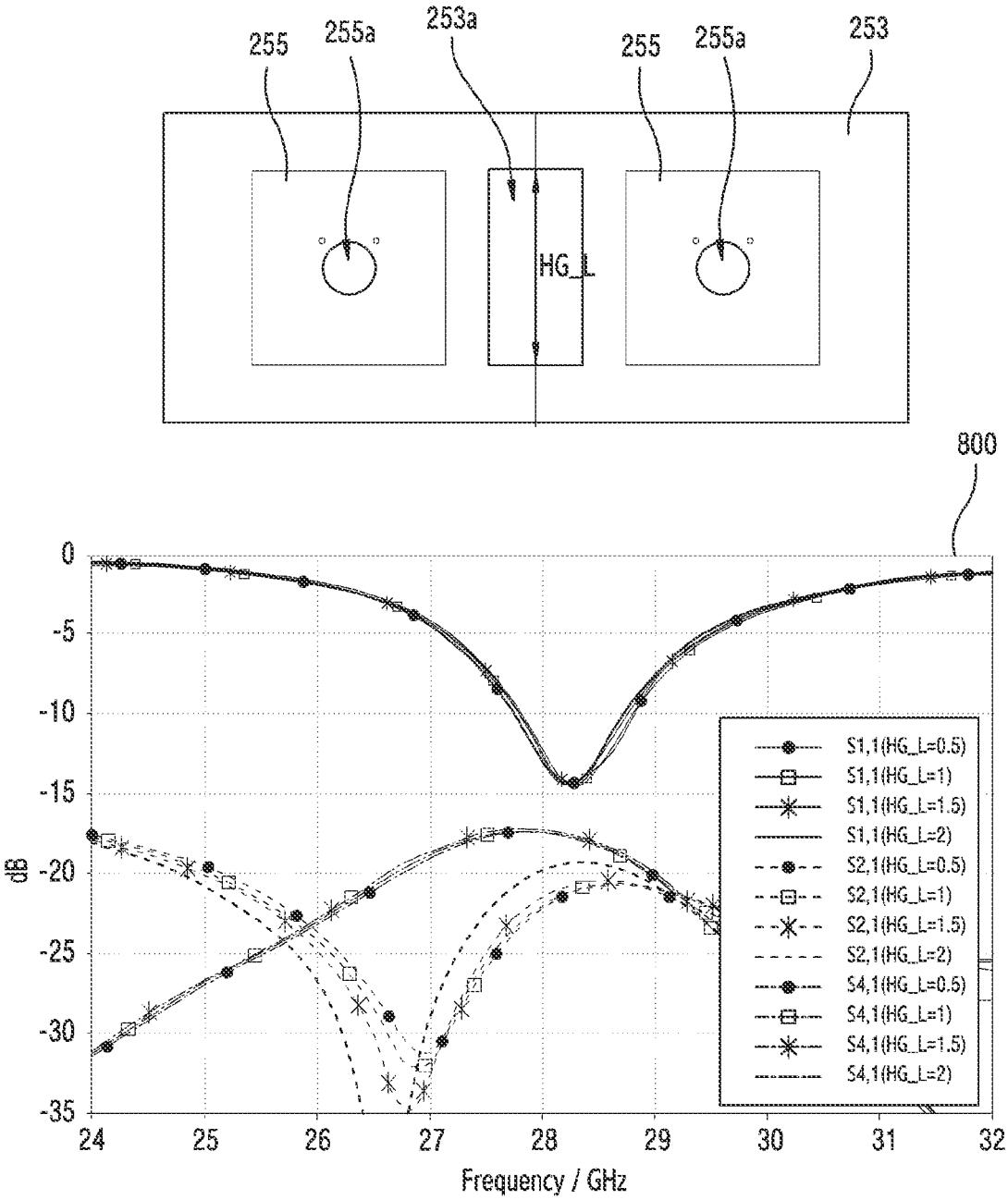
FIG. 8 illustrates a through hole formed between antennas and antenna performance according to the size of the through hole, according to an embodiment.
Figure 9:
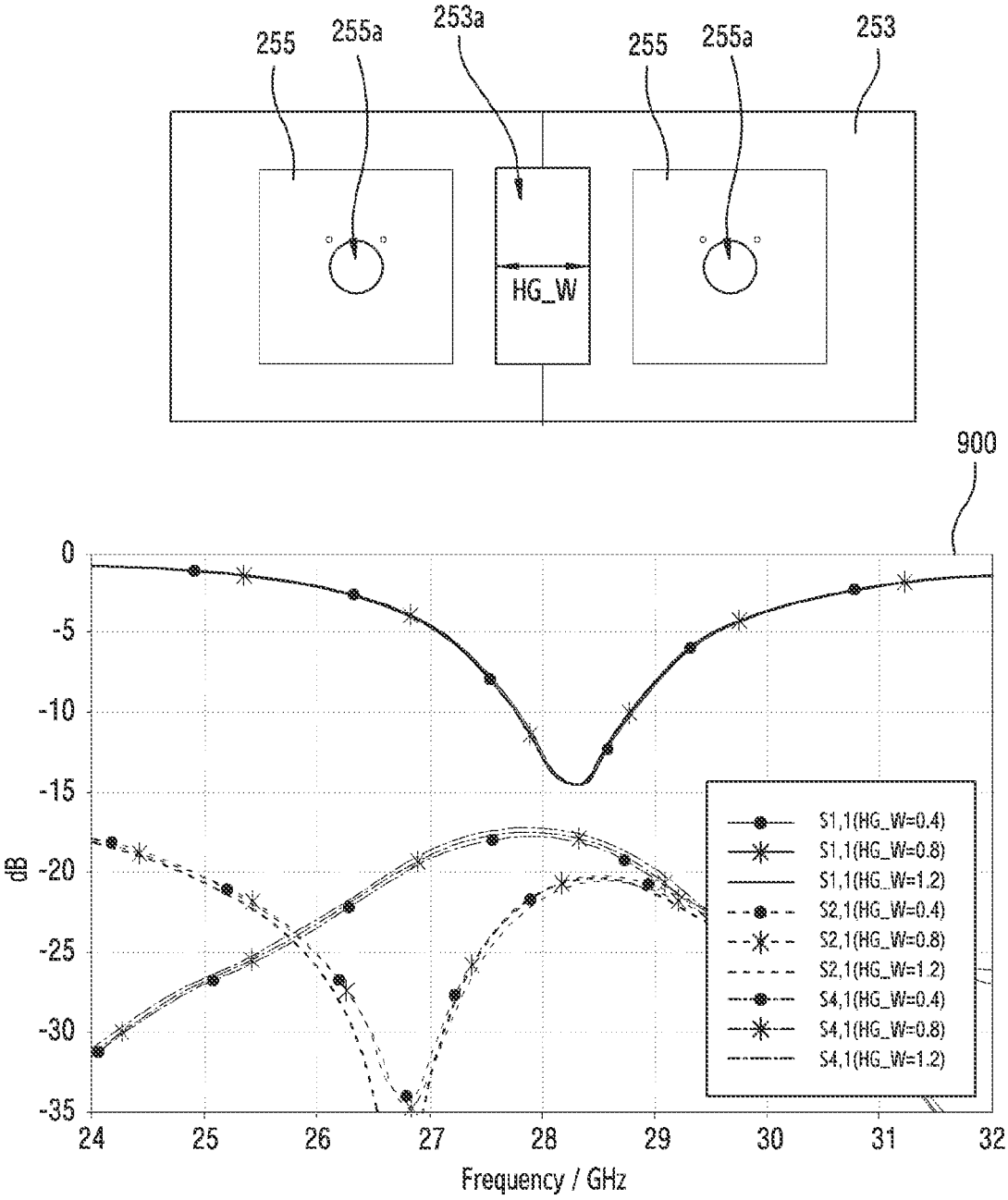
FIG. 9 illustrates a through hole formed between antennas and antenna performance according to the size of the through hole, according to an embodiment.

FIG. 8 illustrates a through hole formed between antennas and antenna performance according to the size of the through hole, according to an embodiment, and FIG. 9 illustrates a through hole formed between antennas and antenna performance according to the size of the through hole, according to an embodiment. Graph 800 of FIG. 8 and graph 900 of FIG. 9 illustrate the frequency characteristics of the patch antennas 255 according to the size (the height (HG_L) and width (HG_W)) of the second through hole 253*a* formed between the patch antennas 255 disposed on the substrate 253.

Referring to FIGS. 8 and 9, it can be seen that the size of the second through-hole 253*a* formed between the patch antennas 255 has minimal affect the frequency characteristics of the patch antennas 255. For example, even if the height and width of the second through hole 253*a* are increased or decreased, the frequency characteristics of the patch antennas 255 may be substantially the same.

The size of the second through hole 253*a* may be set in consideration of the size of the first through holes 255*a*, each of which being formed in the center of one of the patch antennas 255, and the sound radiation efficiency of the sound module 270. For example, the sum of the total size of the first through holes 255*a* formed in the centers of the patch antennas 255 and the total size of the second through holes 253*a* may be set to satisfy the minimum resonance area for sound radiation, such as about 13 $mm^2$ or more.

Figure 10A:
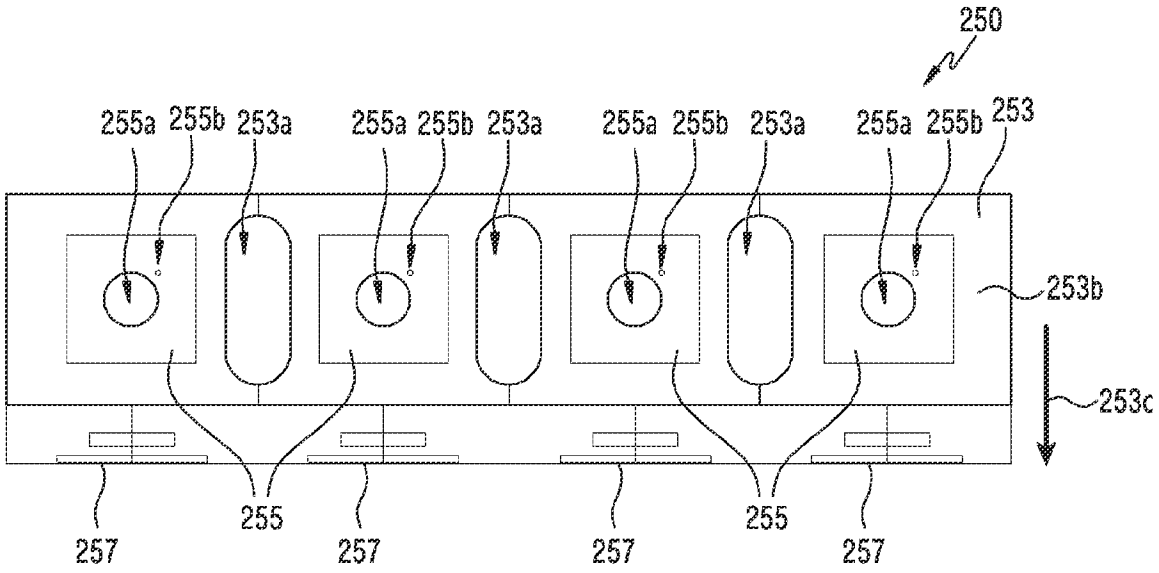
FIG. 10A illustrates an antenna structure including patch antennas and dipole antennas according to an embodiment.
Figure 10B:
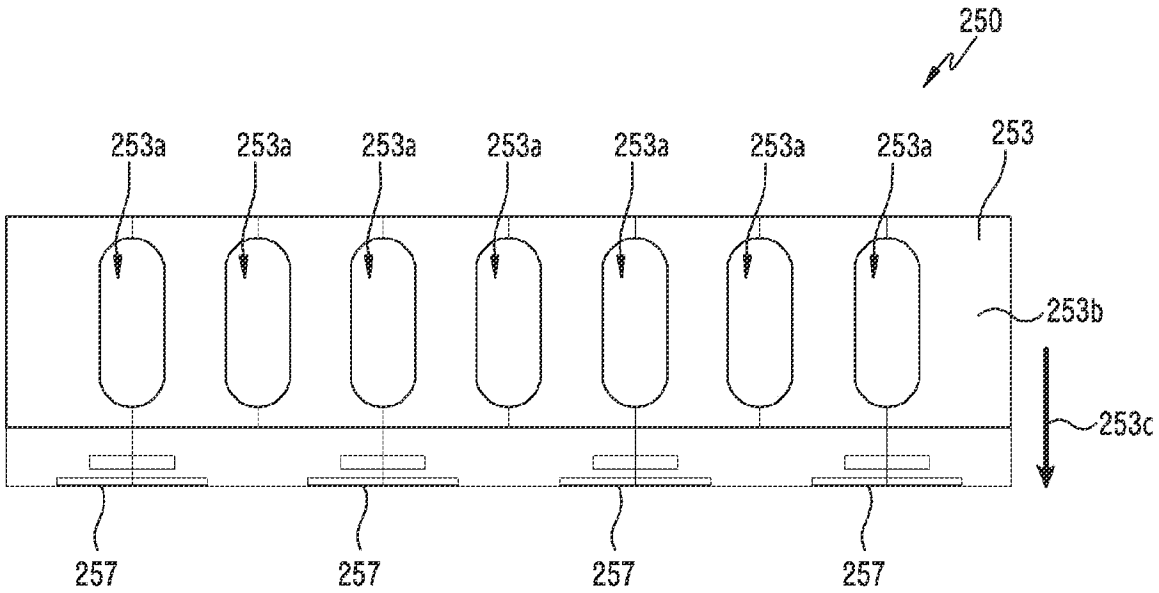
FIG. 10B illustrates an antenna structure including dipole antennas according to an embodiment.

FIG. 10A illustrates an antenna structure including patch antennas and dipole antennas according to an embodiment, and FIG. 10B illustrates an antenna structure including dipole antennas according to an embodiment.

Referring to FIGS. 10A and 10B, the antenna structure 250 may include a substrate 253, a plurality of patch antennas 255 disposed on the substrate 253 to be spaced apart from each other by a predetermined distance, and/or a plurality of dipole antennas 257. The antenna structure 250 of FIG. 10A may have a form in which the plurality of dipole antennas 257 is added to the antenna structure 250 of FIG. 6. The antenna structure 250 of FIG. 10B may have a form in which the patch antennas 255 are omitted from the antenna structure 250 of FIG. 10A. In FIGS. 10A and 10B, a description of the same configuration as that of the antenna structure 250 described above with reference to FIG. 6 will be omitted.

The dipole antennas 257 may be disposed to form an antenna array so as to form a radiation pattern in a first direction 253*c* (e.g., the lateral direction) of the substrate 253. When the front surface 253*b* of the substrate 253 is disposed to be oriented in the lateral direction of the electronic device 200 (e.g., the X-axis direction or the Y-axis direction in FIGS. 2 to 4), the dipole antennas 257 disposed in the first direction 253*c* of the substrate 253 may have a radiation pattern in a direction to the front surface 201 or the rear surface 203 of the electronic device 200. For example, the dipole antennas 257 may radiate radio waves through a non-display region (e.g., a black matrix (BM) region) of the display 290 disposed on the front surface 201 of the electronic device 200.

Referring to FIG. 10A, a plurality of dipole antennas 257 may be disposed on the side surface of the substrate 253 to be spaced apart from each other by a predetermined distance. The plurality of dipole antennas 257 may form an antenna array. The plurality of dipole antennas 257 may be aligned and disposed to correspond to the plurality of patch antennas 255 disposed on the substrate 253. As another example, the dipole antennas 257 may be positioned to form a radiation pattern in the first direction 253*c* of the substrate 253, and may not overlap the positions of the first through holes 255*a* or the second through holes 253*a* formed in the substrate 253.

Referring to FIG. 10B, the plurality of dipole antennas may not be disposed on the substrate 253. A plurality of dipole antennas 257 may be disposed on the side surface of the substrate 253 to be spaced from each other by a predetermined distance, and the plurality of patch antennas may not be disposed. Accordingly, unlike the substrate 253 in FIG. 10A, the second through holes 253*a* may be formed at the positions of the first through holes 255*a* in the substrate 253 of FIG. 10B.

Figure 11:
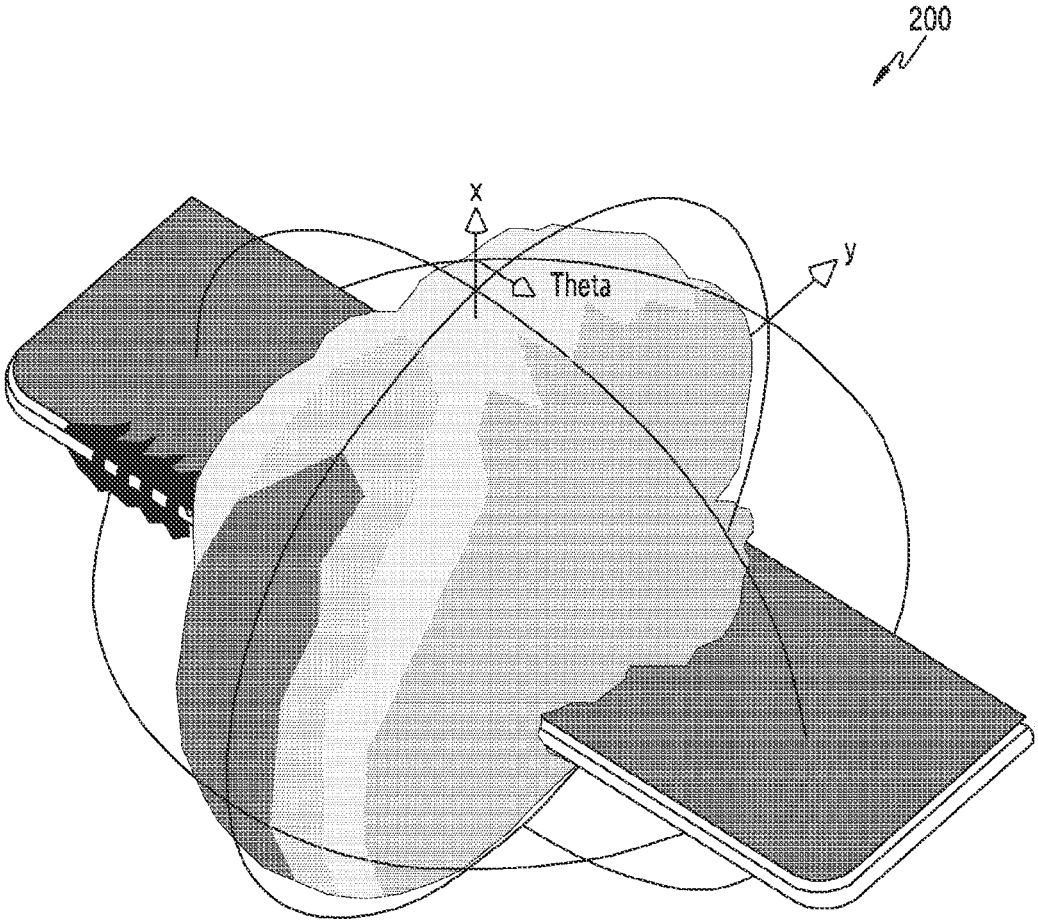
FIG. 11 illustrates a radiation pattern of a patch antenna according to an embodiment.
Figure 12:
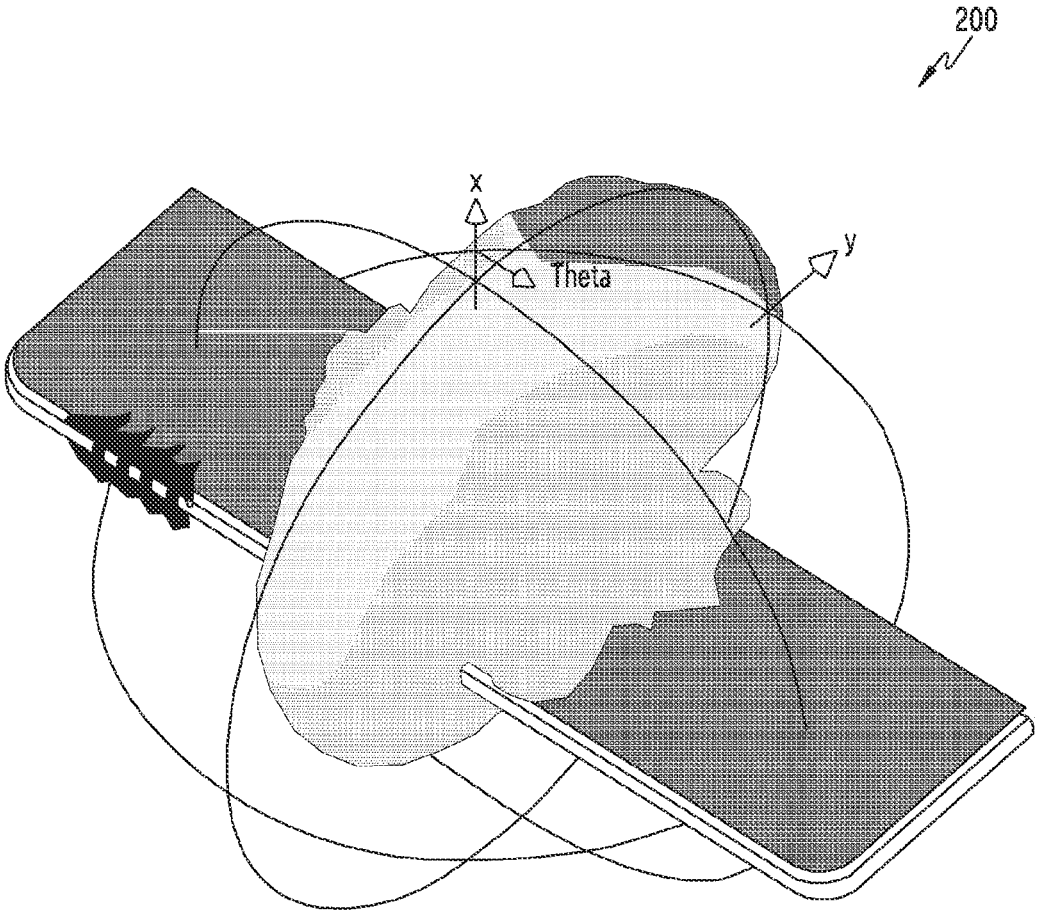
FIG. 12 illustrates a radiation pattern of a dipole antenna according to an embodiment.

FIG. 11 illustrates a radiation pattern of a patch antenna according to an embodiment, and FIG. 12 illustrates a radiation pattern of a dipole antenna according to an embodiment.

Referring to FIGS. 11 and 12, in the electronic device 200, the side surface 205 of the housing 210 may include a conductive portion made of a conductive material and a non-conductive portion made of a non-conductive material. At least one through hole 231 may be formed in the non-conductive portion of the side surface 205 of the housing 210. The at least one through hole 231 may be used as a sound (or light) input/output passage by the sound module 270 (or a camera or sensor module) seated in the housing 210.

As another example, an antenna structure 250 may be disposed between the side surface 205 of the housing 210 and the sound module 270. In order to prevent the sound output from the sound module 270 or the sound to be input to the sound module 270 from being blocked by the antenna structure 250, at least one through hole 251 may be formed in the antenna structure 250. The at least one through hole 251 formed in the antenna structure 250 and the at least one through hole 231 formed in the side surface 205 of the housing 210 may be disposed at positions aligned in the lateral direction of the electronic device 200. For example, the at least one through hole 251 formed in the side surface 250 and the at least one through hole 231 formed in the side surface 205 of the housing 210 may at least partially overlap each other when viewed in the lateral direction of the electronic device 200.

The antenna structure 250 may include a substrate 253, a plurality of patch antennas 255 disposed on the substrate 253 to be spaced apart from each other by a predetermined distance, and/or a plurality of dipole antennas 257 disposed in the lateral direction 253*c* of the substrate. The antenna structure 250 may be disposed such that the front surface 253*b* of the substrate 253 is oriented in the lateral direction of the electronic device 200. For example, the antenna structure 250 may be disposed such that the substrate 253 is erected in a direction perpendicular to the lateral direction of the electronic device 200 in the vertical direction of the electronic device 200. In this case, as illustrated in FIG. 11, the plurality of patch antennas 255 included in the antenna structure 250 may form a beam pattern in the lateral direction of the electronic device 200. As illustrated in FIG. 12, the at least one dipole antenna 257 included in the antenna structure 250 may form a beam pattern in the forward direction 201 of the electronic device. For example, the plurality of patch antennas 255 may radiate radio waves through a non-conductive portion disposed on the side surface of the housing 210. As another example, the at least one dipole antenna 257 may radiate radio waves through a non-display region (e.g., a BM region) of the display 290 disposed on the front surface of the electronic device 200.

Figure 13:
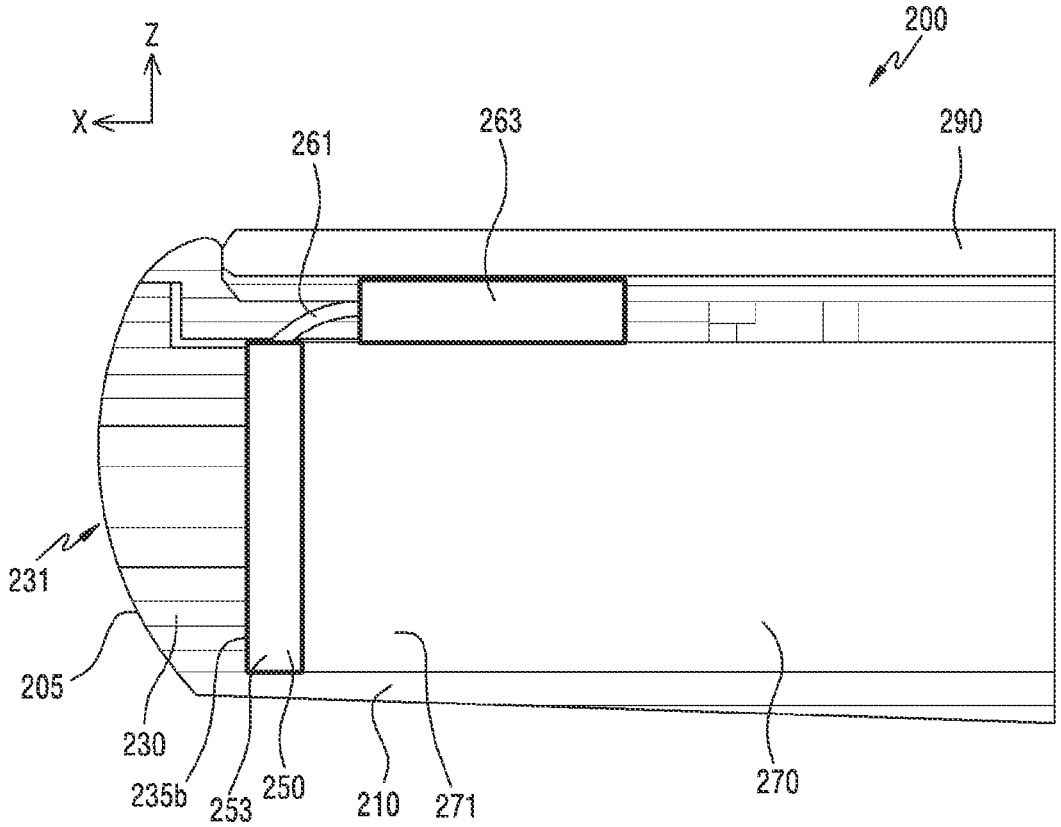
FIG. 13 illustrates a form in which an antenna structure is disposed according to first embodiment.
Figure 14:
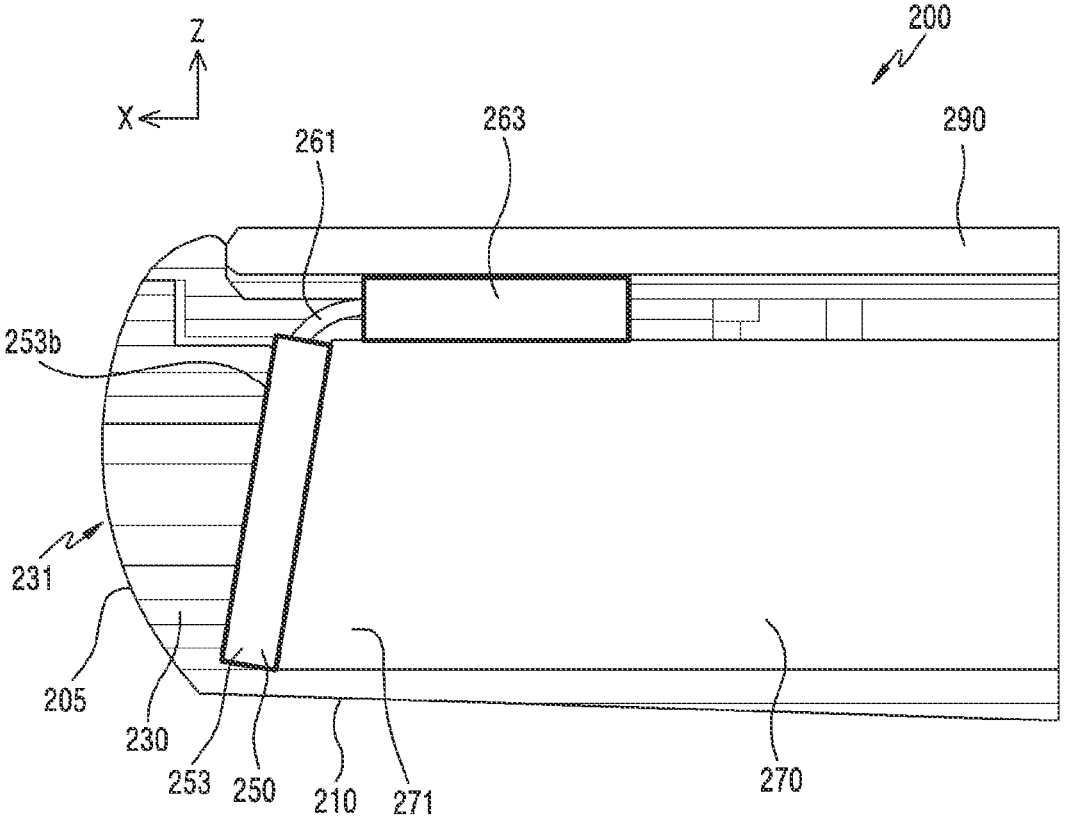
FIG. 14 illustrates a form in which an antenna structure is disposed according to a second embodiment.
Figure 15:
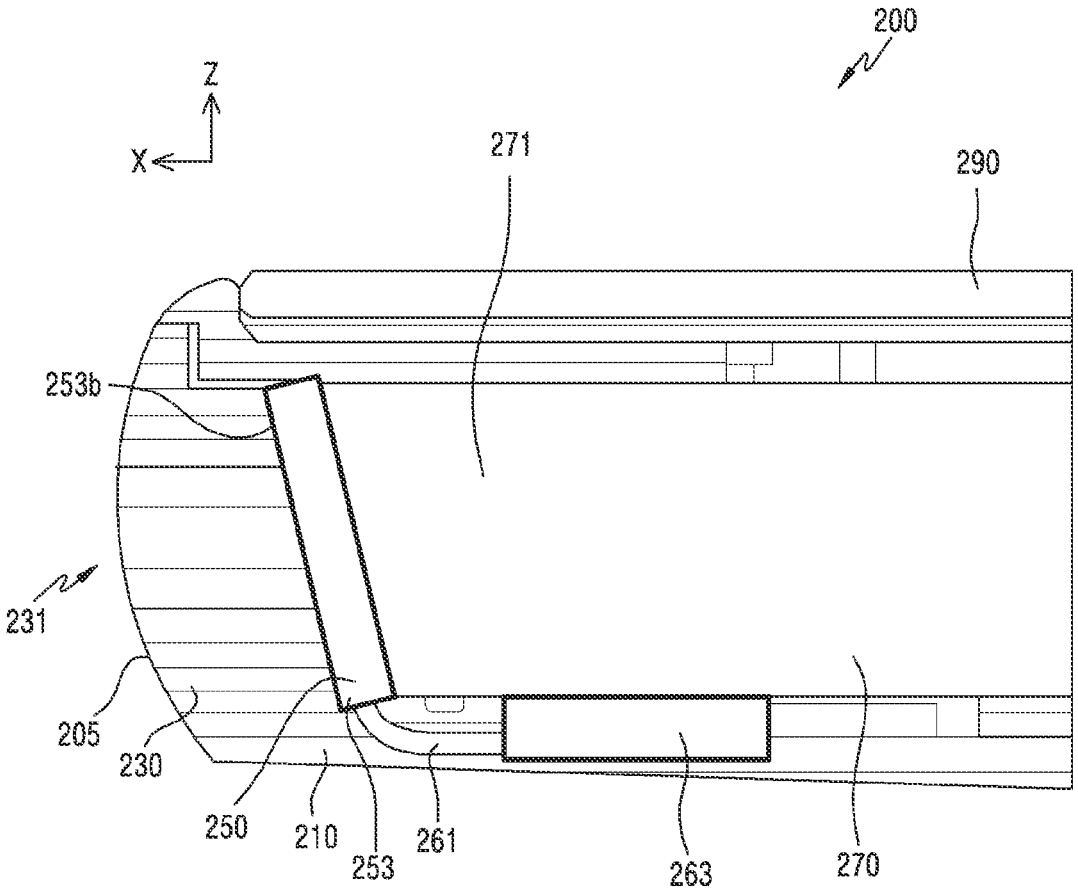
FIG. 15 illustrates a form in which an antenna structure is disposed according to a third embodiment.
Figure 16A:
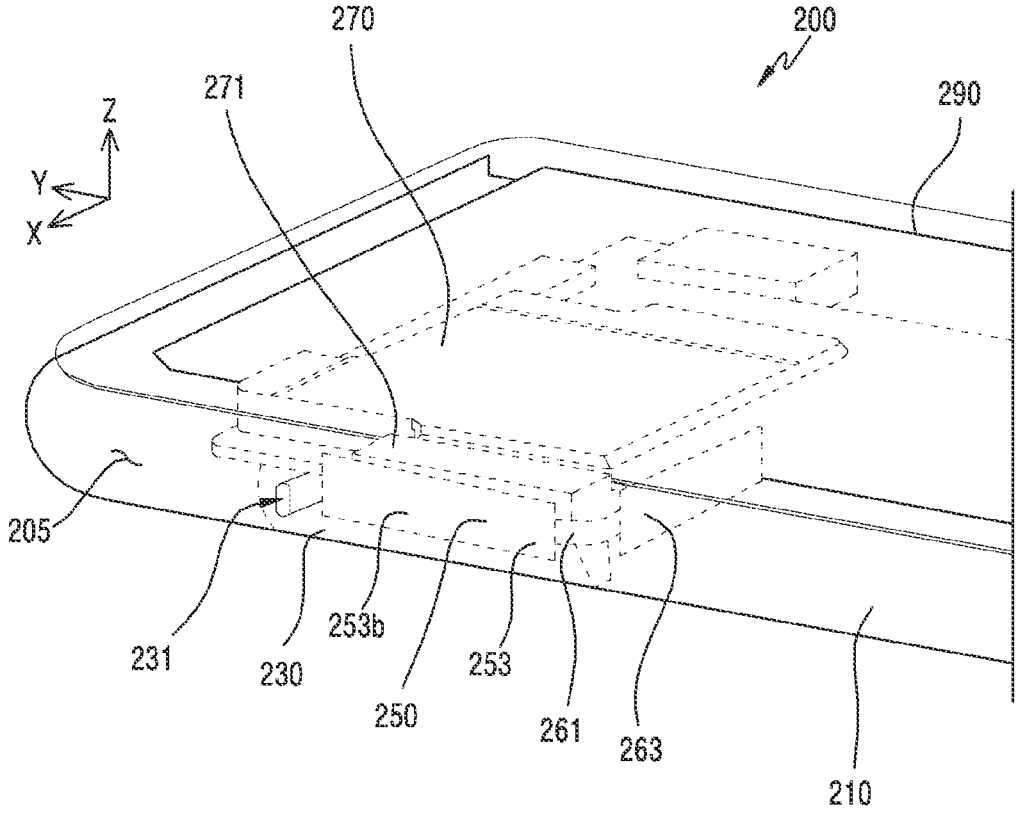
FIG. 16A illustrates a form in which an antenna structure is disposed according to a fourth embodiment.
Figure 16B:
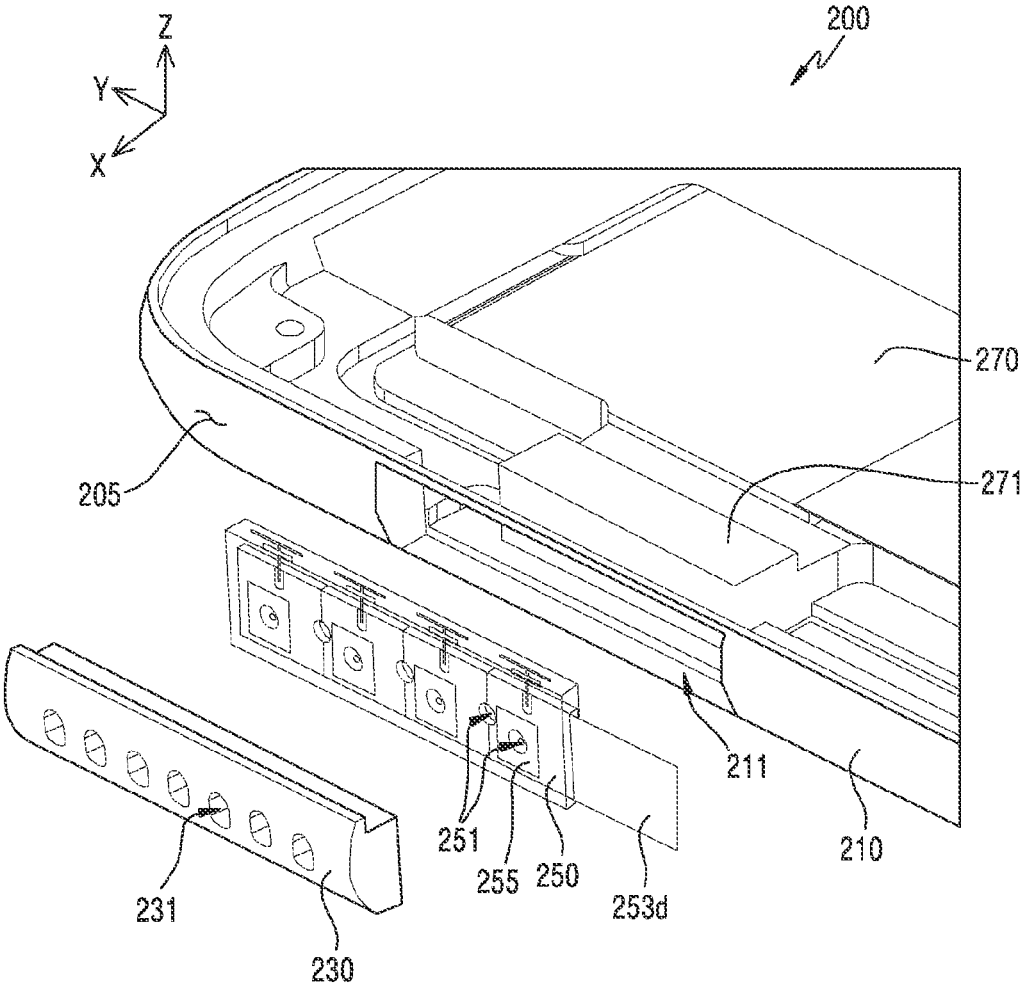
FIG. 16B illustrates a form in which an antenna structure is disposed according to fifth embodiment.

FIG. 13 illustrates a form in which an antenna structure is disposed according to a first embodiment, FIG. 14 illustrates a form in which an antenna structure is disposed according to a second embodiment, FIG. 15 illustrates a form in which an antenna structure is disposed according to a third embodiment, FIG. 16A illustrates a form in which an antenna structure is disposed according to a fourth embodiment, and FIG. 16B illustrates a form in which an antenna structure is disposed according to a fifth embodiment.

Referring to FIGS. 13, 14, 15, 16A and 16B, the antenna structure 250 may be disposed between the side surface 205 of the housing 210 and the sound module 270 disposed inside the housing 210. For example, the antenna structure 250 may be disposed such that the front surface 253*b* of the substrate 253 is oriented in the lateral direction of the electronic device 200. The antenna structure 250 may be disposed such that the substrate 253 is substantially perpendicular to the lateral direction of the electronic device 200 (to be erect in the forward direction of the electronic device 200 (the Z-axis direction)). FIGS. 13, 16A, and 16B illustrate when the antenna structure 250 is disposed perpendicular to the lateral direction of the electronic device 200, and FIGS. 14 and 15 illustrate when the antenna structure 250 is obliquely disposed to form a predetermined angle with the lateral direction of the electronic device 200.

The form in which the antenna structure 250 is disposed may be determined depending on the shape and/or the penetration direction of the at least one through hole 231 formed in the side surface of the housing 210, or of the at least one through hole 251 formed in the antenna structure 250. As an example, the direction in which the front surface 253*b* of the substrate 253 of the antenna structure 250 is oriented may be determined so as to correspond to the penetration direction of the at least one through hole 231 formed in the side surface 205 of the housing 210. When the penetration direction of the at least one through hole 231 is parallel to the lateral direction of the electronic device 200, the direction in which the front surface of the substrate 253 is oriented may also be parallel to the lateral direction of the electronic device 200. When the penetration direction of the at least one through hole 231 forms a predetermined angle with the lateral direction of the electronic device 200, the direction in which the front surface 253*b* of the substrate 253 is oriented may also form the predetermined angle with the lateral direction of the electronic device 200.

When the antenna structure 250 is obliquely disposed to form a predetermined angle with the lateral direction of the electronic device 200, the resonance region (or the resonance area) of the sound for the sound module 270 can be expanded. For example, since the antenna structure 250 is obliquely disposed, the volume occupied by the at least one through hole 231 formed in the side surface of the housing 210 can be increased, and thus the resonance region of sound can also be expanded.

By adjusting the form in which the antenna structure 250 is disposed, it is also possible to adjust the radiation direction of the antenna included in the antenna structure 250. For example, when the antenna structure 250 is obliquely disposed to form a predetermined angle with the lateral direction of the electronic device 200, the radiation direction of the antenna may also be determined as a direction changed by the angle with reference to the lateral direction of the electronic device 200.

The antenna structure 250 may include a PCB 263 on which an RFIC 260 electrically connected to a patch antenna 255 and/or a dipole antenna 257 is disposed. For example, the RFIC 260 may be connected to the patch antenna 255 and/or the dipole antenna 257 through a flexible PCB (FPCB) 261. For example, a feed line from the RFIC 260 to the patch antenna 255 and/or the dipole antenna 257 may be implemented through the FPCB 261.

The location where the substrate 263 including the RFIC 260 is disposed may be determined based on the inner space of the housing. For example, referring to FIGS. 13 and 14, the substrate 263 may be disposed between the sound module 270 and the display 290. Referring to FIG. 15, the substrate 263 may be disposed between the sound module 270 and the rear surface. FIG. 16A illustrates when the substrate 263 is disposed on the side surface of the sound module 270.

As illustrated in FIG. 16B, the substrate 253 of the antenna structure 250 may extend by a predetermined length in the direction in which the plurality of patch antennas 255 are aligned. For example, the substrate 253 may include a portion 253*d* extending in the direction in which the plurality of patch antennas 255 are aligned. Since the plurality of patch antennas 255 are aligned along the side surface 205 of the electronic device 200 (disposed to be spaced apart from each other by a predetermined distance in the forward direction of the electronic device 200 (Y-axis direction)), the extension portion 253*d* may extend in the Y-axis direction. When the electronic device 200 is viewed in the X-axis direction, the extension portion 253*d* may not overlap at least one through hole 231 formed in the side surface 205 of the electronic device 200. The RFIC 260 may be disposed on one surface of the extension portion 253*d*.

Figure 17:
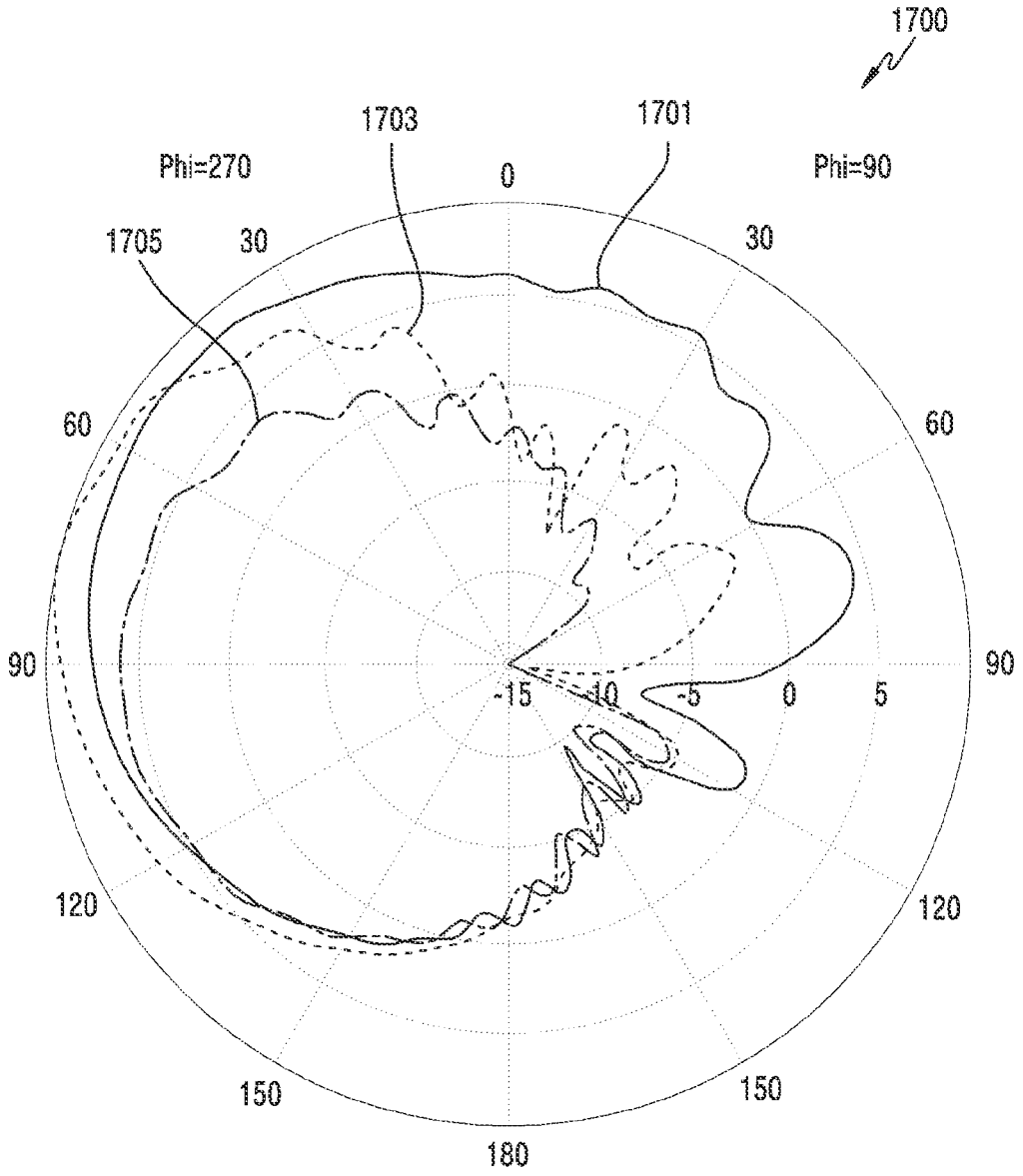
FIG. 17 illustrates antenna radiation performance according to a form in which an antenna structure is disposed according to an embodiment.

The substrate 253 of the antenna structure 250 may include PCB or an FPCB. The RFIC 260 may be disposed on a substrate 263 electrically connected to the substrate 253 of the antenna structure 250 through the FPCB 261. The substrate 263 on which the RFIC 260 is disposed may include a PCB, FIG. 17 illustrates antenna radiation performance according to the form in which an antenna structure is disposed according to an embodiment. Graph 1700 of FIG. 17 shows first, second and third radiation performances. First antenna, radiation performance (1701) of the antenna structure 250 in when the antenna structure 250 is disposed perpendicular to the lateral direction of the electronic device 200, as illustrated in FIGS. 13, 16A, and 16B. Second antenna radiation performance (1703) of the antenna structure 250 in when the lower end of the antenna structure 250 (e.g., the portion adjacent to the rear surface 203 of the electronic device 200) is obliquely disposed to be closer to the side surface of the electronic device 200 than the upper end of the antenna structure 250 (e.g., the portion adjacent to the front surface 201 of the electronic device) such that the antenna structure 250 forms a predetermined angle with the lateral direction of the electronic device 200, as illustrated in FIG. 14. Third antenna, performance (1705) of the antenna structure 250 in when the antenna structure 250 is obliquely disposed to form a predetermined angle with the lateral direction of the electronic device 200 such that the upper end of the antenna structure 250 is closer to the side surface of the electronic device 200 than the lower end, as illustrated in FIG. 15.

Referring to FIG. 17, the radiation performance of the antenna structure 250 may vary depending on the form in which the antenna structure 250 is disposed. For example, referring to the first antenna radiation performance 1701, it can be seen that when the antenna structure 250 is disposed perpendicular to the lateral direction of the electronic device 200, the radiation performance of the antenna structure 250 is excellent not only in the lateral direction of the electronic device 200, but also in the forward direction of the electronic device 200. However, when comparing the first antenna radiation performance (1701) with the second antenna radiation performance (1703), it can be seen that the radiation performance of the antenna structure 250 in the lateral direction of the electronic device 200 when the antenna structure 250 is obliquely disposed to be closer to the side surface of the electronic device 200 so as to form a predetermined angle with the lateral direction of the electronic device 200 than that in the case in which the antenna structure 250 is disposed perpendicular to the lateral direction of the electronic device 200. When the antenna structure 250 is obliquely disposed to form a predetermined angle with the lateral direction of the electronic device 200, and the antenna structure 250 is obliquely disposed such that the upper end thereof is closer to the side surface of the electronic device 200 than the lower end thereof, impedance mismatching may occur due to a conductive member disposed on the rear surface of the electronic device 200, as can be seen from the third antenna radiation performance (1705).

The radiation performance of the antenna structure 250 may be determined by the thickness of a cover glass forming the front surface of the electronic device 200, the spacing distance between the antenna structure 250 and the side surface of the housing 210, among other examples.

Figure 18:
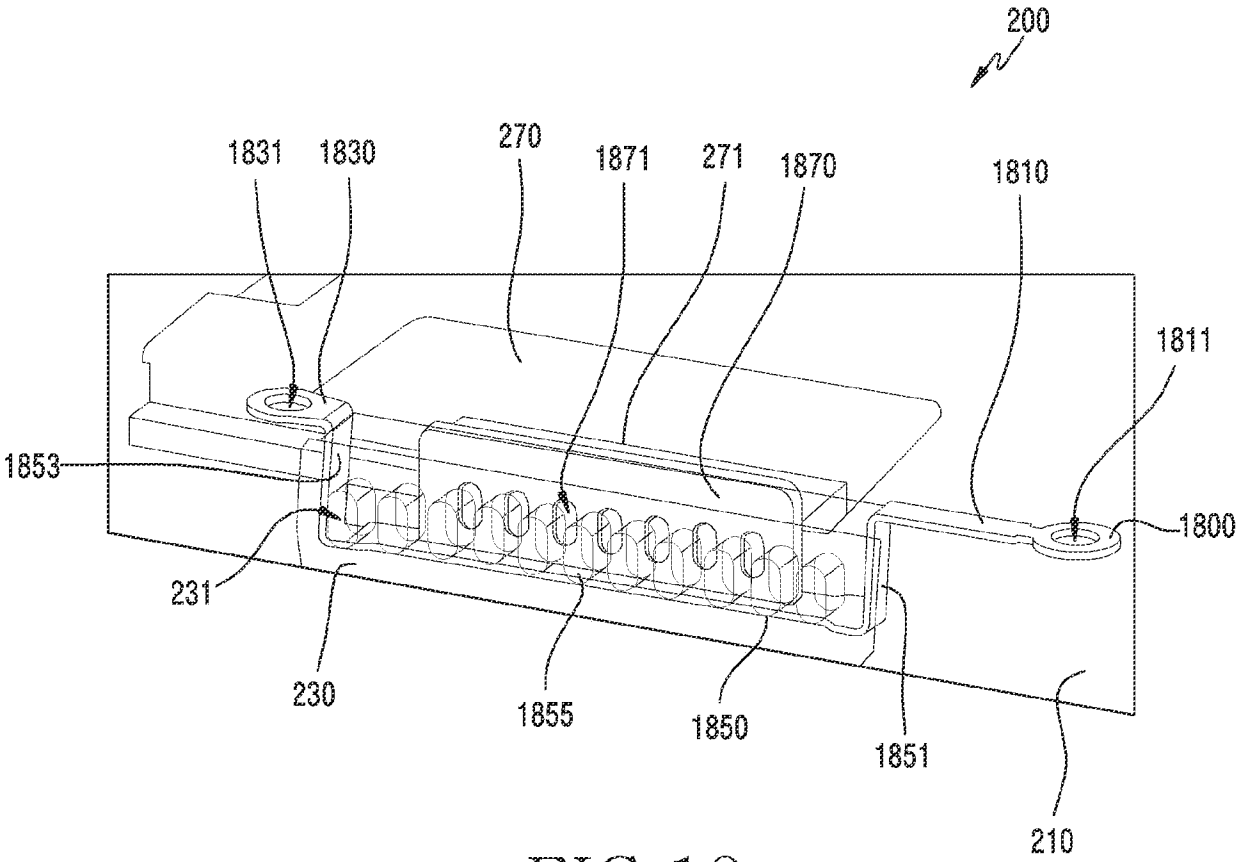
FIG. 18 illustrates a supporting structure of an antenna structure according to a first embodiment.
Figure 19:
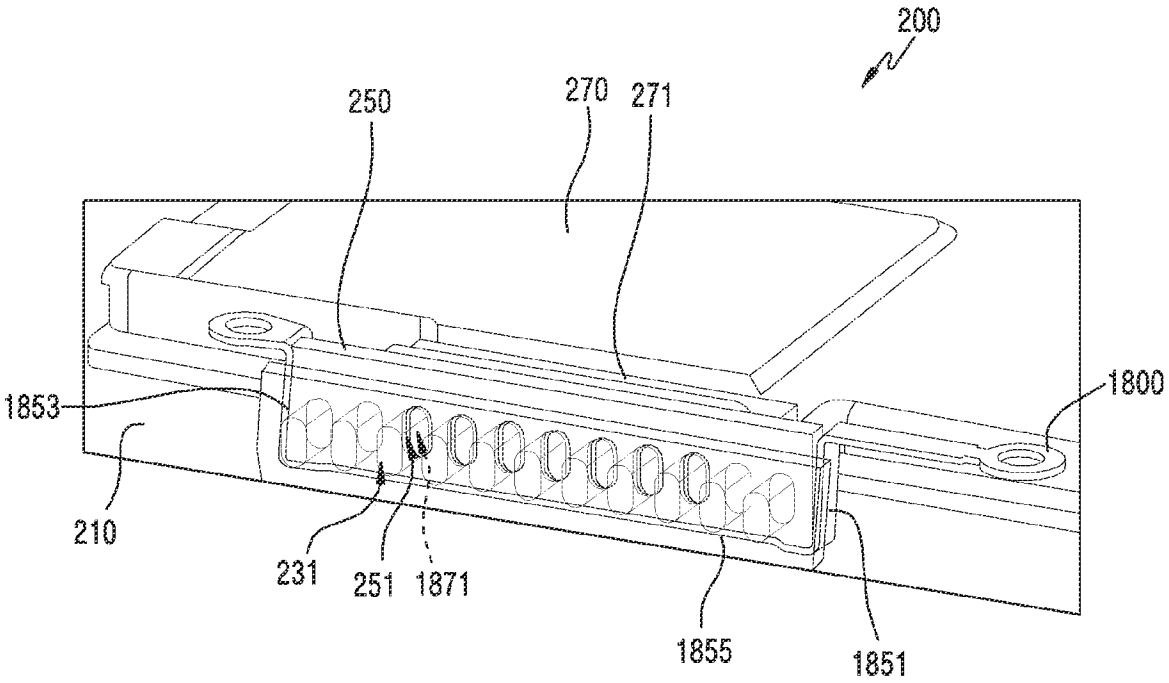
FIG. 19 illustrates a supporting structure of an antenna structure according to a second embodiment.
Figure 20:
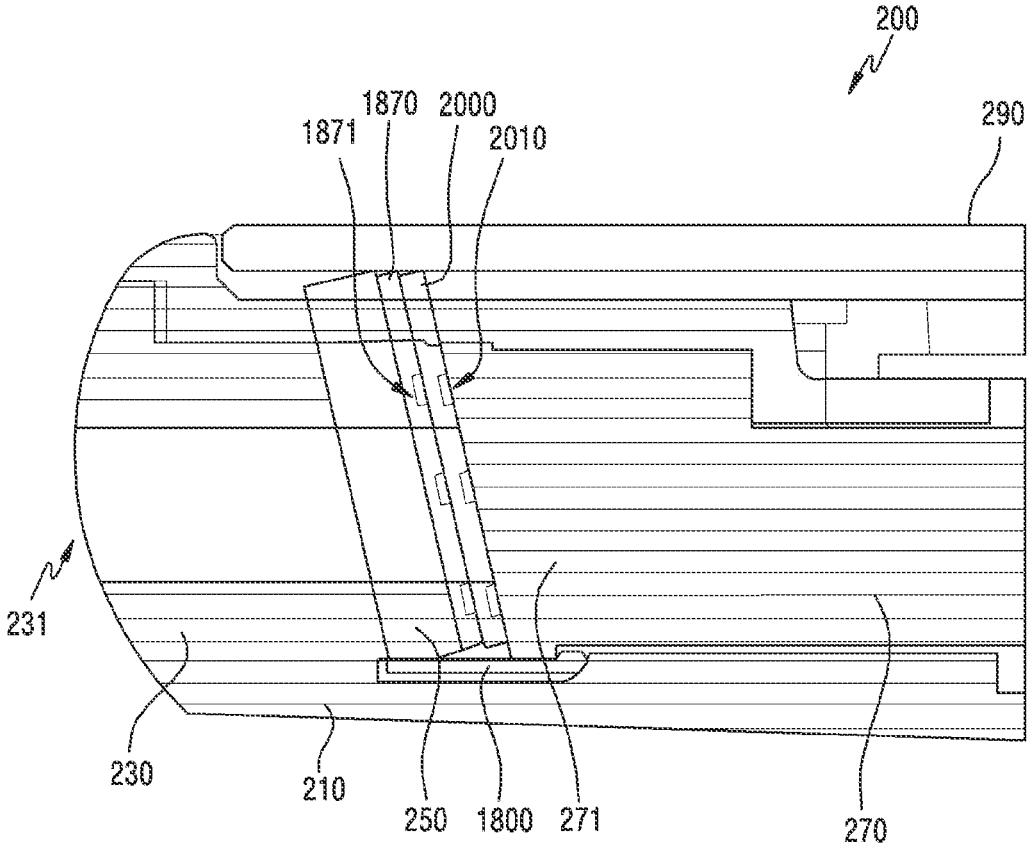
FIG. 20 illustrates a supporting structure of an antenna structure according to a third embodiment.

FIG. 18 illustrates a supporting structure of an antenna structure according to a first embodiment, FIG. 19 illustrates a supporting structure of an antenna structure according to a second embodiment, and FIG. 20 illustrates a supporting structure of an antenna structure according to a third embodiment.

Referring to FIGS. 18, 19 and 20, the electronic device 200 may include a housing 210, an antenna structure 250, a sound module 270, a display 290, and/or a support member 1800. The electronic device 200 may have a form in which the support member 1800 is added to the electronic device 200 of FIGS. 2 to 5. In FIGS. 18 to 20, a description of configurations that are substantially the same as those of the electronic device 200 described with reference to FIGS. 2 to 5 will be omitted.

The support member 1800 may provide a space in which the antenna structure 250 can be seated and may stably fix and support the antenna structure 250. The support member 1800 may be formed to correspond to the length, width, and/or thickness of the antenna structure 250. The support member 1800 may extend to be stepped at both end portions thereof in the height direction. Accordingly, a space defined by the steps formed in the support member 1800 may be utilized as a space in which the antenna structure 250 can be seated. At least a portion of the support member 1800 may be formed of a material having strength of a predetermined level or higher (e.g., a stainless steel (SUS) material).

The support member 1800 may include a first frame 1850 on which the antenna structure 250 is seated and a second frame 1870 disposed on one surface of the first frame 1850 and disposed between the antenna structure 250 and the sound module 270 when the antenna structure 250 is seated on the first frame 150. However, the configuration of the support member 1800 is not limited thereto. At least one of the above-mentioned components may be omitted from the support member 1800, or the support member 1800 may further include one or more other components. For example, the support member 1800 may not include the second frame 1870.

The support member 1800 may extend to be stepped at both end portions thereof in the Z-axis direction in FIGS. 2 to 4. For example, the first frame 1850 of the support member 1800 may include a central portion 1855, a first extension portion 1851 connected to one end of the central portion 1855, a second extension portion 1853 connected to the other end of the central portion 1855, a first end portion 1810 connected to an end of the first extension portion 1851, and/or a second end portion 1830 connected to an end of the second extension portion 1853. In this case, the central portion 1855 is disposed to extend along the side surface 205 of the housing 210, and the first and second extension portions 1851 and 1853 are bent at positions at which they are connected to the central portion 1855 and extend a predetermined length in the height direction.

In another example, the first end portion 1810 and the second end portion 1830, which are respectively connected to the ends of the first extension portion 1851 and the second extension portion 1853, may extend along the side surface in a direction away from the central portion 1855. The length of the central portion 1855 disposed to extend along the side surface 205 corresponds to the length of the antenna structure 250, and the width of the central portion 1855 corresponds to the thickness of the antenna structure 250. Alternatively, the length of the first and second extensions 1851 and 1853 extending in the height direction may correspond to the width of the antenna structure 250.

The first end portion 1810 and/or the second end portion 1830 may serve to fix the support member 1800 to the electronic device 200. For example, the first end portion 1810 and the second end portion 1830 may include a first hole 1811 and a second hole 1831, respectively. Screw members are inserted into the first hole 1811 and the second hole 1831 when the support member 1800 is coupled to the electronic device 200. The first hole 1811 and the second hole 1831 may be formed through the ends of the first end portion 1810 and the second end portion 1830, respectively.

The second frame 1870 is installed on one surface of the first frame 1850, and when the antenna structure 250 is seated on the first frame 150, the second frame 1870 may be disposed between the antenna structure 250 and the sound module 270, and may support the side surface of the antenna structure 250. At least one through hole 1871 may be formed in the second frame 1870.

As illustrated in FIG. 19, when the antenna structure 250 is seated on the first frame 1850, the second frame 1870 is positioned between the antenna structure 250 and the sound module 270. Thus, in order to prevent the sound output from the sound module 270 or the sound to be input to the sound module 270 from being blocked by the second frame 1870, at least one through hole 1871 may be formed in the second frame 1870. The at least one through hole 1871 formed in the second frame 1870 may communicate with the at least one through hole 251 formed in the antenna structure 250 and the at least one through hole 231 formed in the side surface 205 of the housing 210. FIGS. 18 and 19 illustrate when a plurality of through holes 1871 are formed in the second frame 1870. The at least one through hole 231 formed in the side surface 205 of the housing 210, the at least one through hole 251 formed in the antenna structure 250, and the at least one through hole 1871 formed in the second frame 1870 may be disposed to be aligned in the lateral direction of the electronic device 200. For example, when viewed in the lateral direction of the electronic device 200, the at least one through hole 231 formed in the side surface 205 of the housing 210, the at least one through hole 251 formed in the antenna structure 250, and the at least one through hole 1871 formed in the second frame 1870 may at least partially overlap each other.

The second frame 1870 may include at least one protrusion extending from the surface facing the front surface 201 or the rear surface 203 and bent in the lateral direction of the electronic device 200 to extend by a predetermined length. The protrusion may prevent play of the antenna, structure 250 seated on the first frame 1850 in the forward direction of the electronic device 200 and may prevent the antenna structure 250 from deviating from the first frame 1850.

The support member 1800 may be bonded to the sound module 270 and the housing 210 using an adhesive member 2000. For example, the adhesive member 2000 may be disposed between the second frame 1870 and the sound module 270 to bond the second frame 1870 to the sound module 270.

As illustrated in FIG. 20, when the adhesive member 2000 is disposed between the second frame 1870 and the sound module 270, in order to prevent the sound output from the sound module 270 or the sound to be input to the sound module 270 from being blocked by the adhesive member 2000, at least one through hole 2010 may be formed in the adhesive member 2000. For example, the at least one through hole 2010 formed in the adhesive member 2000 may communicate with the at least one through hole 1871 formed in the second frame 1870, the at least one through hole 251 formed in the antenna structure 250, and the at least one through hole 231 formed in the side surface 205 of the housing 210.

Referring to FIG. 20, a plurality of through holes 2010 are formed in the adhesive member 2000. The at least one through hole 231 formed in the side surface 205 of the housing 210, the at least one through hole 251 formed in the antenna structure 250, the at least one through hole 1871 formed in the second frame 1870, and the at least one through hole 2010 formed in the adhesive member 2000 may be disposed to be aligned in the lateral direction of the electronic device 200. For example, when viewed in the lateral direction of the electronic device 200, the at least one through hole 231 formed in the side surface 205 of the housing 210, the at least one through hole 251 formed in the antenna structure 250, the at least one through hole 1871 formed in the second frame 1870, and the at least one through hole 2010 formed in the adhesive member 2000 may at least partially overlap each other.

Figure 21:
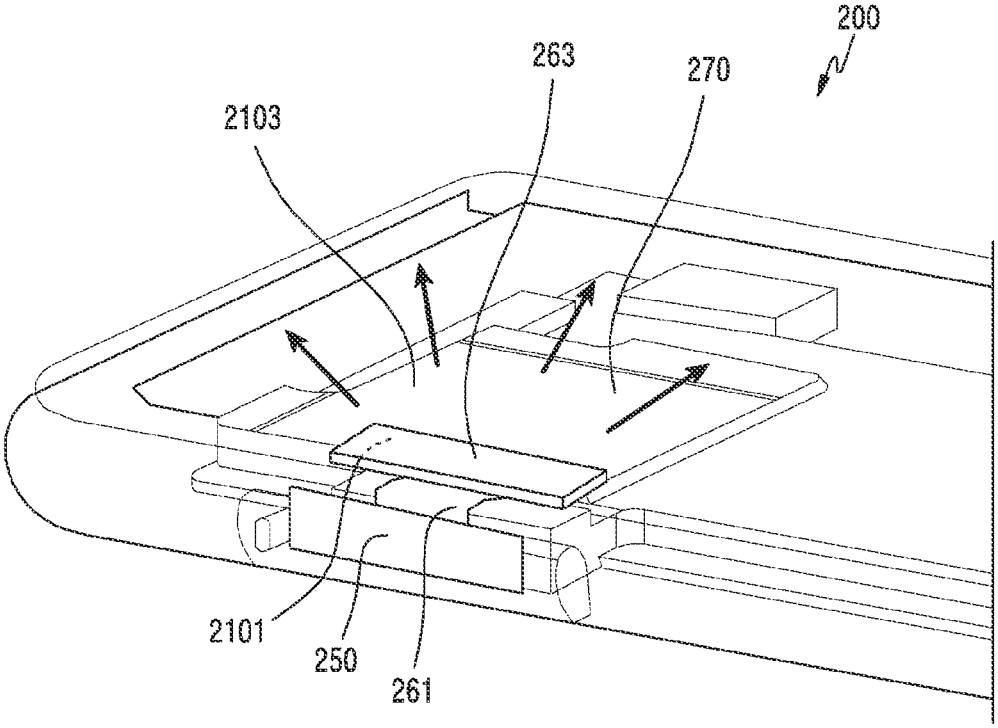
FIG. 21 illustrates a heat dissipation structure of an antenna structure according to an embodiment.

FIG. 21 illustrates a heat dissipation structure of an antenna structure according to an embodiment.

Referring to FIG. 21, the antenna structure 250 may include an RFIC 260 electrically connected to the antennas included in the antenna structure 250 via the FPCB 261. The antenna structure 250 may include a first substrate 253 on which antennas are disposed, a second substrate 263 on which the MC 260 is disposed, and an FPCB 261 connecting the first substrate 253 and the second substrate 263 to each other. As another example, the substrate 263 on which the RFIC 260 is disposed may be disposed on one surface of the sound module 270.

FIG. 21 illustrates when the substrate 263 on which the RFIC 260 is disposed is disposed between the sound module 270 and the front surface 201.

The sound module 270 may include a first portion 2101 adjacent to or in contact with the substrate 263 on which the RFIC 260 is disposed and a second portion adjacent to the first portion 2101, and at least one of the first portion 2101 and the second portion 2103 may be formed of a material having high thermal conductivity (e.g., a material having predetermined thermal conductivity or higher). For example, at least one of the first portion 2101 and the second portion 2103 may be formed of a conductive material. Accordingly, the heat generated by the RFIC 260 may be effectively released to the outside through at least one of the first portion 2101 and the second portion 2103 of the sound module 270 formed of the material having high thermal conductivity. Referring to FIG. 21, a first portion 2101 of the sound module 270 that is in contact with the substrate 263 on which the MC 260 is disposed may be formed of a material having high thermal conductivity.

Figure 22:
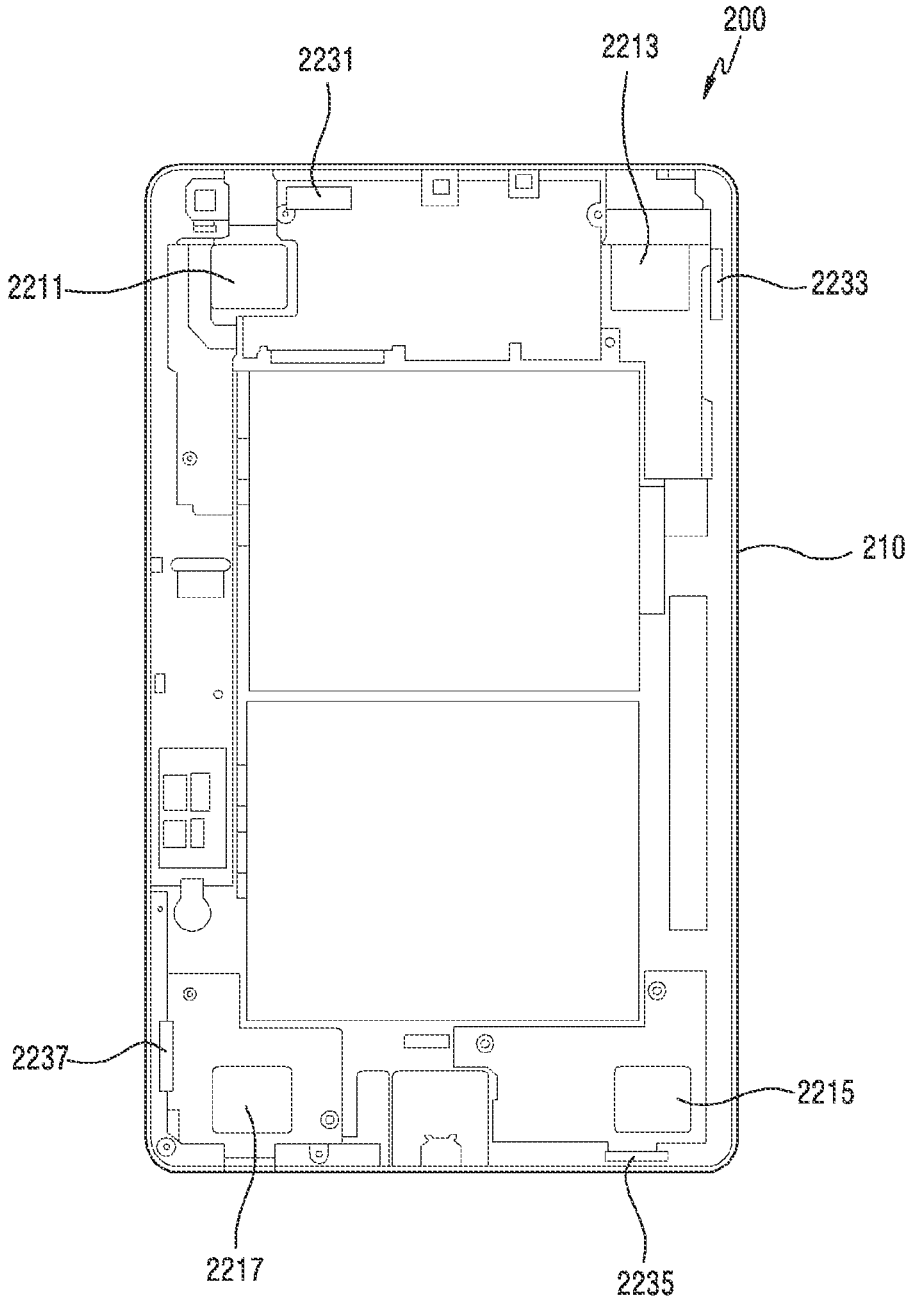
FIG. 22 illustrates a position at which an antenna structure according to an embodiment is disposed.

FIG. 22 illustrates the position at which an antenna structure according to an embodiment is disposed.

Referring to FIG. 22, the electronic device 200 may include a plurality of sound modules 2211, 2213, 2215, and 2217 (e.g., the sound module 270) and a plurality of antenna structures 2231, 2233, 2235, and 2237 (e.g., the antenna structure 250). The plurality of antenna structures 2231, 2233, 2235, and 2237 may be disposed horizontally or vertically depending on the spatial condition in the housing 210 together with the plurality of sound modules 2211, 2213, 2215, and 2217. For example, as illustrated in FIG. 22, the first antenna structure 2231 disposed adjacent to the first sound module 2211 may be disposed such that the front surface 253*b* of the substrate 253 faces the front surface 201 of the electronic device 200, and the second antenna structure 2233, the third antenna structure 2235, and the fourth antenna structure 2237, which are respectively disposed adjacent to the second sound module 2213, the third sound module 2215, and the fourth sound module 2217, may be disposed such that the front surfaces thereof (e.g., the substrate 253) face the side surface of the electronic device 200.

As illustrated in FIG. 22, when the sound modules 2211, 2213, 2215, and 2217 are respectively disposed at the upper left and right and the lower left and right of the electronic device 200, and the plurality of antenna structures 2231, 2233, 2235, and 2237 are also respectively disposed at the upper left and right and lower left and right adjacent to the plurality of sound modules 2211, 2213, 2215, and 2217, it may be advantageous in securing omnidirectional beam coverage with respect to the electronic device 200.

Figure 23A:
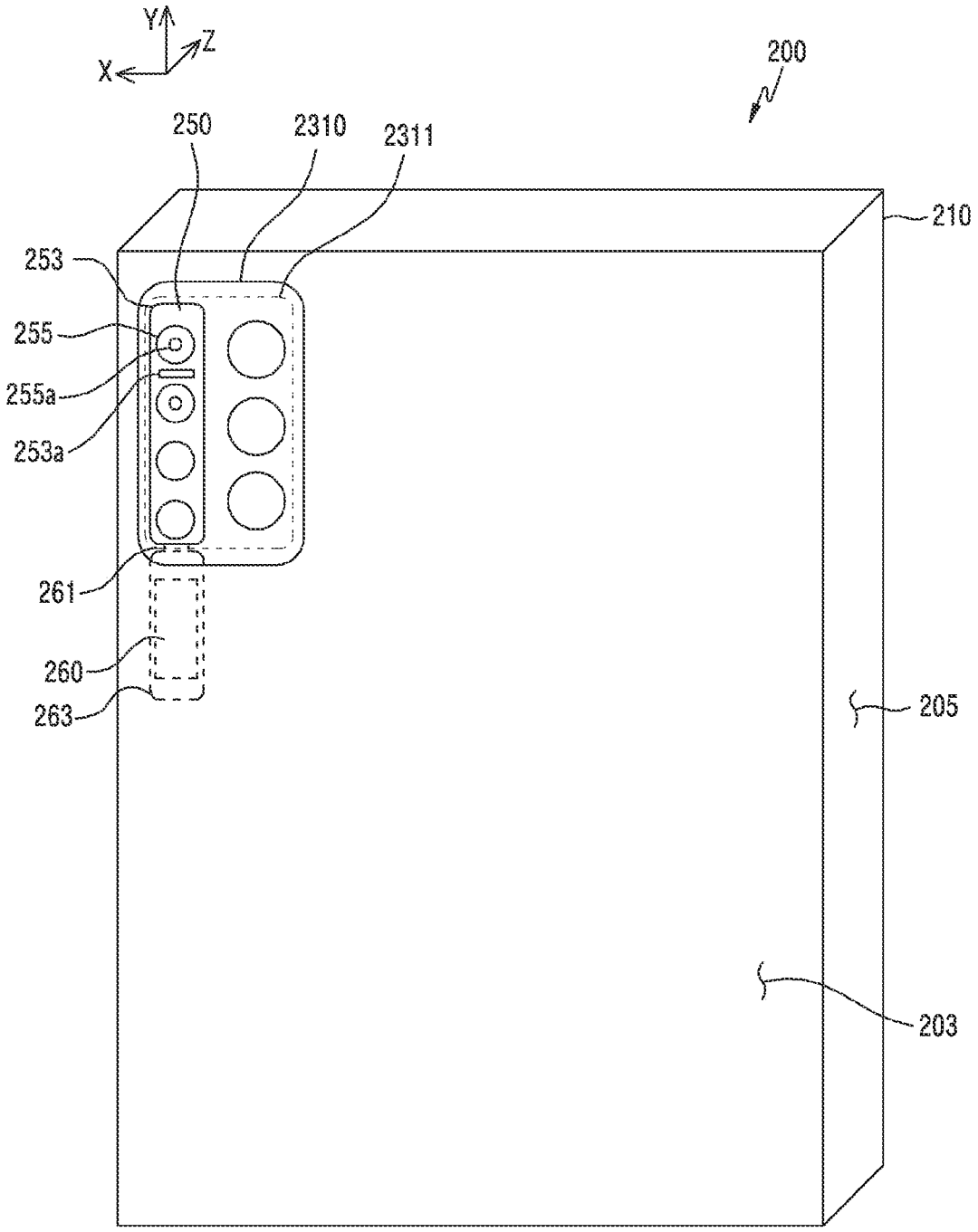
FIG. 23A illustrates an electronic device according to a first embodiment.
Figure 23B:
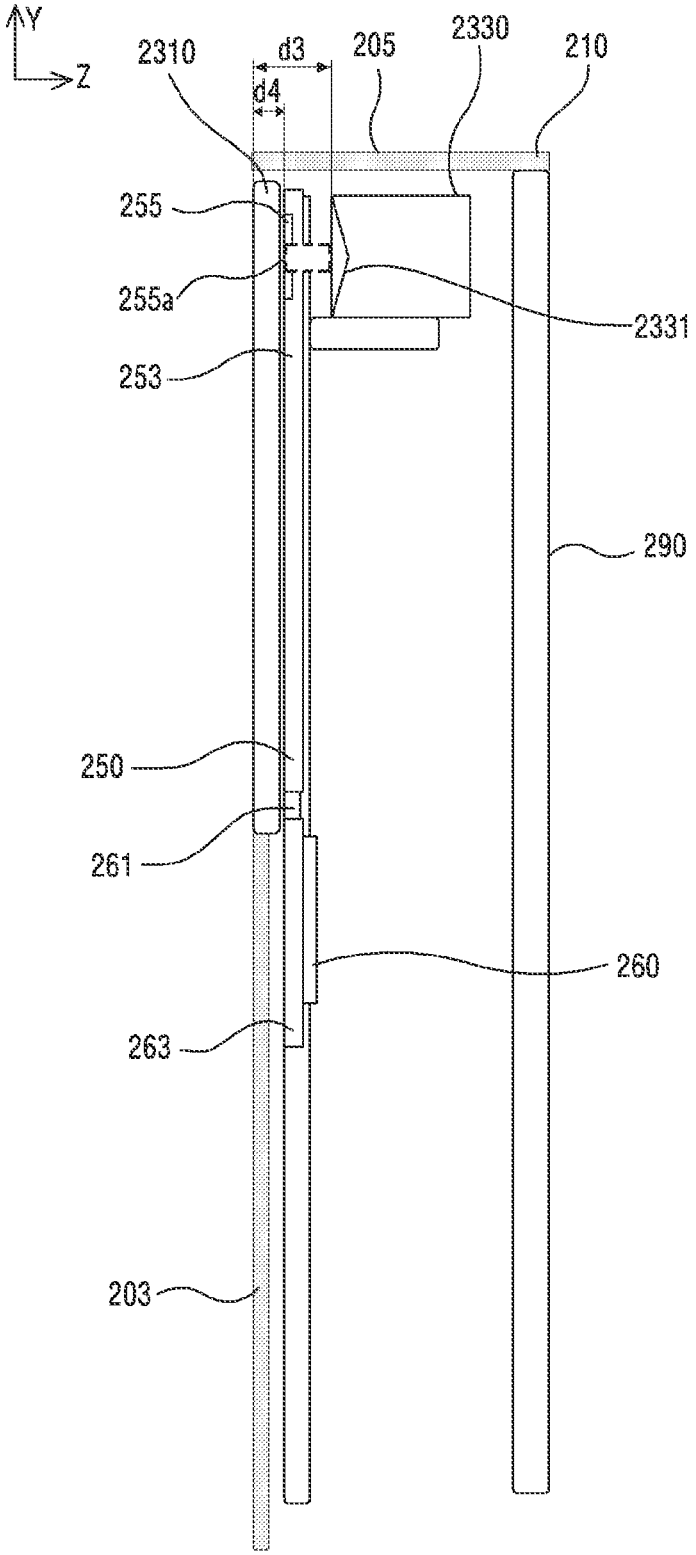
FIG. 23B illustrates an electronic device according to the first embodiment.
Figure 24A:
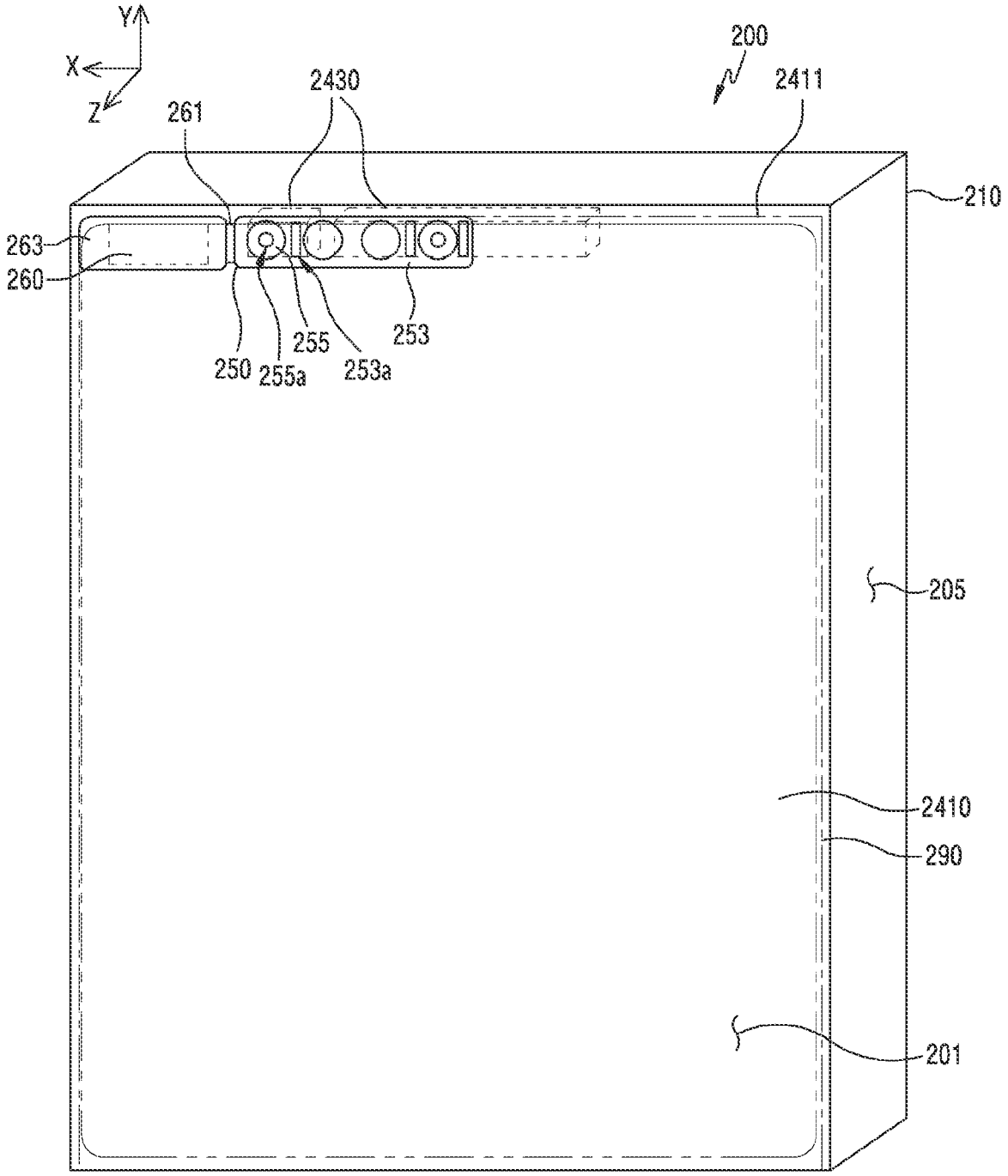
FIG. 24A illustrates an electronic device according to a second embodiment.
Figure 24B:
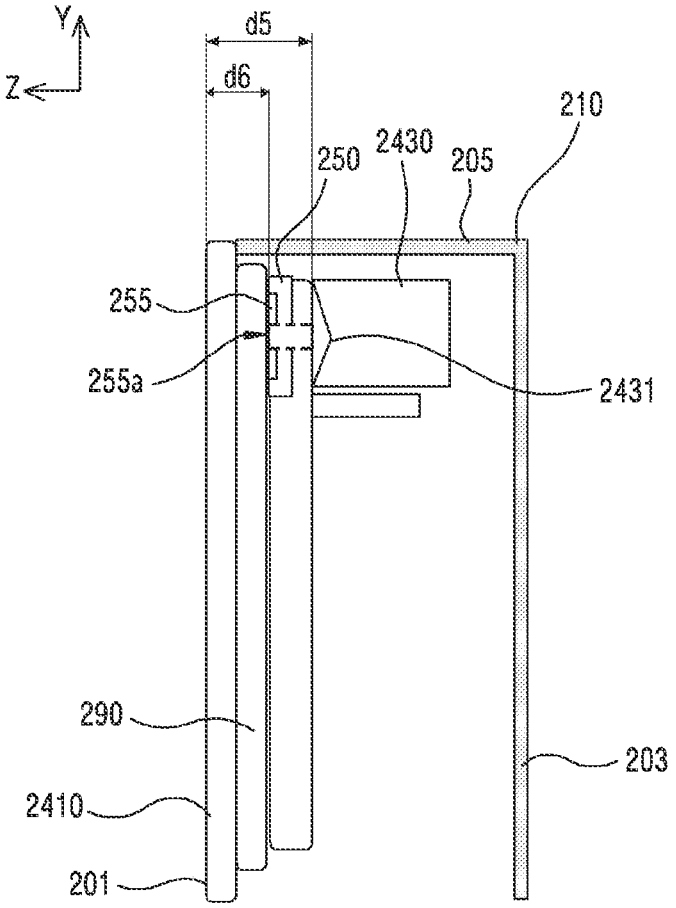
FIG. 24B illustrates an electronic device according to the second embodiment.

FIG. 23A illustrates an electronic device according to a first embodiment, FIG. 23B illustrates an electronic device according to the first embodiment, FIG. 24A illustrates an electronic device according to a second embodiment, and FIG. 24B illustrates an electronic device according to the second embodiment. The electronic device 200 of FIGS. 23A, 23B, 24A and 24B is substantially the same as the electronic devices 200 illustrated in FIGS. 2 to 5. In the following description made with reference to FIGS. 23A, 23B 24A and 24B, a description of configurations that are substantially the same as those of the electronic device 200 described with reference to FIGS. 2 to 5 will be omitted.

FIGS. 2 to 5 illustrate when the antenna structure 250 and the acoustic module 270 overlap each other in a partial region when viewed in the lateral direction of the electronic device 200. FIGS. 23A and 23B illustrate when the front surface 253*b* of the antenna structure 250 is disposed to face the rear surface 203 of the electronic device 200 and the antenna structure 250 and the camera module 2330 overlap each other in a partial region when viewed from above the rear surface 203 of the electronic device 200, and FIGS. 24A and 24B illustrate when the front surface 253*b* of the antenna structure 250 is disposed to face the front surface 201 of the electronic device 200 and the antenna structure 250 and the camera module 2430 overlap each other in a partial region when viewed from above the front surface 201 of the electronic device 200.

Referring to FIGS. 23A and 23B, the electronic device 200 may include a housing 210, an antenna structure 250, a camera module 2330, and/or a display 290.

A decorative window 2310 may be disposed on the rear surface 203 of the housing 210. The decorative window 2310 may include a transparent region 2311, and the transparent region 2311 may be used as an optical input/output passage by the camera module 2330. For example, external light may be incident on the lens 2331 of the camera module 2330 through the transparent region 2311.

The antenna structure 250 may include a plurality of patch antennas 255 disposed on the first substrate 253 to be spaced apart from each other by a predetermined distance. The plurality of patch antennas 255 may form an antenna array. The antenna structure 250 may be electrically connected to the second substrate 263, on which the RFIC 260 is disposed, via an FPCB 261. FIGS. 23A and 23B illustrate when the first substrate 253, the FPCB 261, and the second substrate 263 of the antenna structure 250 are disposed to extend along the rear surface 203 of the electronic device 200, but the disclosure is not limited thereto. The second substrate 263, on which the RFIC 260 is disposed, may be disposed to form a predetermined angle with the first substrate 253 of the antenna structure 250. A patch antenna 255 disposed on the antenna structure 250 may be an mmWave antenna for mmWave wireless communication using a millimeter-wave band.

The camera module 2330 may be disposed at a position spaced apart from the rear surface 203 of the housing 210, on which the decorative window 2310 is disposed, by a first distance d3 toward the inside of the electronic device 200 (e.g., in the Z-axis direction). The antenna structure 250 may be disposed at a position spaced apart from the rear surface 203 of the housing 210, on which the decorative window 2310 is disposed, by a second distance d4, which is shorter than the first distance, toward the inside of the electronic device 200 (e.g., in the Z-axis direction). For example, the antenna structure 250 may be disposed between the rear surface 203 of the housing 210 and the camera module 2330. At least one through hole 251 is formed in the antenna structure 250 such that light to be input to the camera module 2330 is not blocked by the antenna structure 250. For example, the at least one through hole formed in the antenna structure 250 may include at least one first through hole 255*a* formed through at least one of the plurality of patch antennas 255 and/or at least one second through hole 253*a* formed in the region between the plurality of patch antennas 255.

The transparent region 2311 of the decorative window 2310 disposed on the rear surface 203 of the housing 210 and the at least one through hole formed in the antenna structure 250 (e.g., the first through hole 255*a* and/or the second through hole 253*a*) may be disposed to be aligned in the rearward direction (e.g., the -Z-axis direction) of the electronic device 200. For example, when viewed from above the rear surface 203 of the electronic device 200 (e.g., in the Z-axis direction), the transparent region 2311 of the decorative window 2310 disposed on the rear surface 203 of the housing 210 and the at least one through hole formed in the antenna structure 250 may overlap each other in at least a partial region.

FIGS. 23A and 23B illustrate the positional relationship between the antenna structure 250 and the camera module 2330, but the disclosure is not limited thereto. The camera module 2330 may be replaced with a sensor module. The sensor module may include a fingerprint sensor, a proximity sensor, or an iris sensor.

Referring to FIGS. 24A and 24B, the electronic device 200 may include a housing 210, an antenna structure 250, a camera module 2430, and/or a display 290.

A window 2410 for protecting the display 290 may be disposed on the front surface 201 of the housing 210. The window 2310 may include a transparent region 2411, and a screen of the display 290 may be exposed to the outside through the transparent region 2411. As another example, the transparent region 2411 may be used as an optical input/output passage by the camera module 2430. For example, external light may be incident on the lens 2431 of the camera module 2430 through the transparent region 2411.

The antenna structure 250 may include a plurality of patch antennas 255 disposed on the first substrate 253 to be spaced apart from each other by a predetermined distance. The plurality of patch antennas 255 may form an antenna array. The antenna structure 250 may be electrically connected to the second substrate 263, on which the RFIC 260 is disposed, via an FPCB 261. FIGS. 24A and 24B illustrate when the first substrate 253, the FPCB 261, and/or the second substrate 263 of the antenna structure 250 are disposed to extend along the front surface 201 of the electronic device 200, but the disclosure is not limited thereto. The second substrate 263 on which the RFIC 260 is disposed may be disposed to form a predetermined angle with the first substrate 253 of the antenna structure 250. A patch antenna 255 disposed on the antenna structure 250 may be an mmWave antenna for mmWave wireless communication using a millimeter-wave band.

The camera module 2430 may be disposed at a position spaced apart from the front surface 201 of the housing 210, on which the window 2410 is disposed, toward the inside of the electronic device 200 (e.g., in the -Z-axis direction) by a first distance d5, and the antenna structure 250 may be disposed at a position spaced apart from the front surface 201 of the housing 210, on which the window 2410 is disposed, toward the inside of the electronic device 200 (e.g., in the -Z-axis direction) by a second distance do, which is shorter than the first distance. For example, the antenna structure 250 may be disposed between the front surface 201 of the housing 210 and the camera module 2430. At least one through hole 251 is formed in the antenna structure 250 such that light to be input to the camera module 2430 is not blocked by the antenna structure 250. For example, the at least one through hole formed in the antenna structure 250 may include at least one first through hole 255*a* formed through at least one of the plurality of patch antennas 255 and/or at least one second through hole 253*a* formed in the region between the plurality of patch antennas 255.

The transparent region 2411 of the window 2410 disposed on the front surface 201 of the housing 210 and the at least one through hole formed in the antenna structure 250 (e.g., the first through hole 255*a* and/or the second through hole 253*a*) may be disposed to be aligned in the forward direction of the electronic device 200 (e.g., in the Z-axis direction). For example, when viewed from above the front surface of the electronic device 200 (e.g., in the -Z-axis direction), the transparent region 2411 of the window 2410 disposed on the front surface 201 of the housing 210 and the at least one through hole formed in the antenna structure 250 may overlap each other in at least a partial region.

FIGS. 24A and 24B illustrate the positional relationship between the antenna, structure 250 and the camera module 2430, but the disclosure is not limited thereto. The camera module 2430 may be replaced with a sensor module. The sensor module may include a fingerprint sensor, a proximity sensor, or an iris sensor.

According to an embodiment, an electronic device may include a housing including a front surface, a rear surface, and a side surface partially surrounding a space between the front surface and the rear surface, wherein at least one of the front surface, the rear surface, or the side surface includes a non-conductive portion, and at least a partial region of the non-conductive portion includes a first through hole, one or more components at least partially overlapping the first through hole when the non-conductive portion is viewed from outside the housing, wherein the component is disposed at a position spaced apart from the non-conductive portion, in which the first through hole is formed, toward the inside of the housing by a first distance, and an antenna structure disposed at a position spaced apart from the non-conductive portion, in which the first through hole is formed, toward the inside of the housing by a second distance, which is shorter than the first distance, wherein the antenna structure is configured to radiate radio waves through the non-conductive portion. The antenna structure may include at least one second through hole.

The components may include at least one of a sound module, a camera module, or a sensor module.

The antenna structure may include a first substrate including a ground region and a plurality of antenna elements disposed on the first substrate to be spaced apart from each other by a predetermined distance. The at least one second through hole may include at least one third through hole formed through a predetermined region of at least one of the plurality of antenna elements.

At least a portion of the at least one third through hole may overlap the first through hole when the non-conductive portion is viewed from outside the housing.

The at least one second through hole includes at least one fourth through hole formed through a region in which the plurality of antenna elements are not disposed.

At least a portion of the at least one fourth through hole may overlap the first through hole when the non-conductive portion is viewed from outside the housing.

The plurality of antenna elements may include a first antenna element and a second antenna element, the first antenna element may include a first conductive patch, and the second element may include a second conductive patch.

The plurality of antenna elements may include a third antenna element and a fourth antenna element, the third antenna element may include a first conductive pattern and a second conductive pattern, the fourth antenna element may include a third conductive pattern and a fourth conductive pattern, the first conductive pattern and the second conductive pattern may form a first dipole antenna, and the third conductive pattern and the fourth conductive pattern may form a second dipole antenna.

The at least one third through hole may be formed through the central portion of at least one of the first conductive patch or the second conductive patch and may have a diameter of a predetermined size or less.

The sum of the size of the at least one second through hole formed in the antenna structure may be a predetermined size or more.

A first substrate of the antenna structure may be disposed parallel to the non-conductive portion.

A first substrate of the antenna structure may be obliquely disposed to form an acute angle with the non-conductive portion.

The electronic device may further include a support member formed to correspond to at least one of the length, the width, and the thickness of the antenna structure so as to support the antenna structure.

The at least one third through hole may be formed in a circular shape, and the at least one fourth through hole may be formed in a racetrack shape.

The at least one third through hole may be formed in a square shape, and the at least one fourth through hole may be formed in a rectangular shape.

The antenna structure may include an antenna for wireless communication using a millimeter-wave band.

The first substrate may include an extension portion extending a predetermined length in the direction in which the antenna elements are aligned, and an RFIC electrically connected to the plurality of antenna elements may be disposed on a surface of the extension portion.

The antenna structure may further include a second substrate on which an RFIC electrically connected to the plurality of antenna elements is disposed, and the first substrate and the second substrate may be connected to each other via an FPCB.

The second substrate may be disposed between the front surface and the component.

The second substrate may be disposed between the rear surface and the component.

As used herein, the term "module" may include a unit implemented in hardware, software, firmware or any combination thereof, and may interchangeably be used with other terms such as "logic," "logic block," "part," or "circuitry". A module may be a single integral component, or a minimum unit or part thereof, adapted to perform one or more functions. For example, the module may be implemented in a form of an application-specific integrated circuit (ASIC).

Embodiments as set forth herein may be implemented as software including one or more instructions that are stored in a storage medium that is readable by a machine. For example, a processor (e.g., the processor 120) of the machine may invoke at least one of the one or more instructions stored in the storage medium, and execute it, with or without using one or more other components under the control of the processor. This enables the machine to be operated to perform at least one function according to the at least one instruction invoked. The one or more instructions may include a code made by a complier or a code executable by an interpreter. The machine-readable storage medium may be provided in the form of a non-transitory storage medium. The "non-transitory" storage medium is a tangible device, and may not include a signal, but this term does not differentiate between where data is semi-permanently or temporarily stored in the storage medium.

A method according to embodiments of the disclosure may be included and provided in a computer program product which may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component of the above-described components may include a single entity or multiple entities, and some of the multiple entities may be separated and disposed to other component. One or more of the above-described components may be omitted, or one or more other components may be added. Alternatively or additionally, a plurality of components may be integrated into a single component in such a case, the integrated component may still perform one or more functions of each of the plurality of components in the same or similar manner as they are performed by a corresponding one of the plurality of components before the integration. Operations performed by the module, the program, or another component may be performed sequentially, in parallel, repeatedly, or heuristically, or one or more of the operations may be executed in a different order or omitted, or one or more other operations may be added.

While the disclosure has been particularly shown and described with reference to certain embodiments thereof, it will be understood by those skilled in the art that various changes in form and details may be made therein without departing from the scope of the subject matter as defined by the appended claims and their equivalents.

What is claimed is:

1. An electronic device comprising:

a housing comprising a front surface, a rear surface, and a side surface partially surrounding a space between the front surface and the rear surface, wherein at least one of the front surface, the rear surface, and the side surface comprises an opening formed in a partial region thereof;

a cover configured to be inserted into and disposed in the opening, wherein the cover comprises a non-conductive portion, and at least a partial region of the non-conductive portion comprises a first through hole;

a component at least partially overlapping the first through hole when the non-conductive portion is viewed from outside the housing, wherein the component is disposed at a position spaced apart from the non-conductive portion by a first distance; and an antenna structure disposed at a position spaced apart from the non-conductive portion by a second distance shorter than the first distance, wherein the antenna structure is configured to radiate radio waves through the non-conductive portion, wherein the antenna structure comprises at least one second through hole.

2. The electronic device of claim 1, wherein the component comprises at least one of a sound module, a camera module, and a sensor module.

3. The electronic device of claim 1, wherein the antenna structure comprises:

a first substrate comprising a ground region; and a plurality of antenna elements disposed on the first substrate to be spaced apart from each other by a predetermined distance, wherein the at least one second through hole comprises at least one third through hole formed through a predetermined region of at least one of the plurality of antenna elements.

4. The electronic device of claim 3, wherein at least a portion of the at least one third through hole overlaps the first through hole when the non-conductive portion is viewed from outside the housing.

5. The electronic device of claim 3, wherein the at least one second through hole comprises at least one fourth through hole formed through a region in which the plurality of antenna elements are not disposed.

6. The electronic device of claim 5, wherein at least a portion of the at least one fourth through hole overlaps the first through hole when the non-conductive portion is viewed from outside the housing.

7. The electronic device of claim 5, wherein the at least one third through hole is formed in a circular shape, and wherein the at least one fourth through hole is formed in a racetrack shape.

8. The electronic device of claim 5, wherein the at least one third through hole is formed in a square shape, and wherein the at least one fourth through hole is formed in a rectangular shape.

9. The electronic device of claim 3, wherein the plurality of antenna elements comprises a first antenna element and a second antenna element, and wherein the first antenna element comprises a first conductive patch, and the second element comprises a second conductive patch.

10. The electronic device of claim 9, wherein the at least one third through hole is formed through a central portion of at least one of the first conductive patch or the second conductive patch to have a diameter of a predetermined size or less.

11. The electronic device of claim 3, wherein the plurality of antenna elements comprises a third antenna element and a fourth antenna element, and wherein the third antenna element comprises a first conductive pattern and a second conductive pattern, the fourth antenna element comprises a third conductive pattern and a fourth conductive pattern, the first conductive pattern and the second conductive pattern form a first dipole antenna, and the third conductive pattern and the fourth conductive pattern form a second dipole antenna.

12. The electronic device of claim 3, wherein the first substrate comprises an extension portion extending a predetermined length in a direction in which the plurality of antenna elements is aligned, and wherein a radio-frequency integrated circuit (RFIC) electrically connected to the plurality of antenna elements is disposed on a surface of the extension portion.

13. The electronic device of claim 3, wherein the antenna structure further comprises a second substrate on which a radio-frequency integrated circuit (RFIC) electrically connected to the plurality of antenna elements is disposed, and wherein the first substrate and the second substrate are connected to each other via a flexible printed circuit board (FPCB).

14. The electronic device of claim 13, wherein the second substrate is disposed between the front surface and the component.

15. The electronic device of claim 13, wherein the second substrate is disposed between the rear surface and the component.

16. The electronic device of claim 1, wherein a sum of a size of the at least one second through hole formed in the antenna structure is a predetermined size or more.

17. The electronic device of claim 1, wherein a first substrate of the antenna structure is disposed parallel to the non-conductive portion.

18. The electronic device of claim 1, wherein a first substrate of the antenna structure is obliquely disposed to form an acute angle with the non-conductive portion.

19. The electronic device of claim 1, further comprising:

a support member formed to correspond to at least one of a length, a width, and a thickness of the antenna structure so as to support the antenna structure.

20. The electronic device of claim 1, wherein the antenna structure comprises an antenna for wireless communication using a millimeter-wave band.

* * * * *